US007335897B2

(12) United States Patent
Takáts et al.

(10) Patent No.: US 7,335,897 B2
(45) Date of Patent: Feb. 26, 2008

(54) METHOD AND SYSTEM FOR DESORPTION ELECTROSPRAY IONIZATION

(75) Inventors: Zoltán Takáts, Budapest (HU); Bogdan Gologan, Lafayette, IN (US); Justin Michael Wiseman, Indianapolis, IN (US); Robert Graham Cooks, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 288 days.

(21) Appl. No.: 11/090,455

(22) Filed: Mar. 25, 2005

(65) Prior Publication Data

US 2005/0230635 A1 Oct. 20, 2005

Related U.S. Application Data

(60) Provisional application No. 60/558,352, filed on Mar. 30, 2004, provisional application No. 60/611,934, filed on Sep. 21, 2004, provisional application No. 60/612,100, filed on Sep. 22, 2004, provisional application No. 60/627,526, filed on Nov. 12, 2004, provisional application No. 60/630,365, filed on Nov. 23, 2004, provisional application No. 60/643,650, filed on Jan. 13, 2005.

(51) Int. Cl.
*H01J 27/00* (2006.01)
*H01J 49/10* (2006.01)

(52) U.S. Cl. ..... 250/425; 250/288; 250/282

(58) Field of Classification Search ..... 250/288, 250/82, 292, 281, 282, 425

See application file for complete search history.

(56) References Cited

U.S. PATENT DOCUMENTS 5,580,434 A * 12/1996 Robotti et al. ..... 204/451
6,787,313 B2 * 9/2004 Morozov et al. ..... 435/6
6,818,394 B1 * 11/2004 O'Donnell-Maloney et al. ..... 435/6
6,881,588 B2 * 4/2005 Tegeler et al. ..... 436/180

(Continued)

OTHER PUBLICATIONS

International Search Report Jun. 19, 2007 Takats et al.

*Primary Examiner*—Nikita Wells
*Assistant Examiner*—Johnnie L Smith, II
(74) *Attorney, Agent, or Firm*—Lawson & Weitzen, LLP; Sonia K. Guterman; Adam M. Schoen

(57) ABSTRACT

A new method and system for desorption ionization is described and applied to the ionization of various compounds, including peptides and proteins present on metal, polymer, and mineral surfaces. Desorption electrospray ionization (DESI) is carried out by directing charged droplets and/or ions of a liquid onto the surface to be analyzed. The impact of the charged particles on the surface produces gaseous ions of material originally present on the surface. The resulting mass spectra are similar to normal ESI mass spectra in that they show mainly singly or multiply charged molecular ions of the analytes. The DESI phenomenon was observed both in the case of conductive and insulator surfaces and for compounds ranging from nonpolar small molecules such as lycopene, the alkaloid coniceine, and small drugs, through polar compounds such as peptides and proteins. Changes in the solution that is sprayed can be used to selectively ionize particular compounds, including those in biological matrices. In vivo analysis is demonstrated.

47 Claims, 15 Drawing Sheets

U.S. PATENT DOCUMENTS

| | | | | |
|---|---|---|---|---|
| 6,911,182 | B2 * | 6/2005 | Tegeler et al. | 422/100 |
| 7,015,465 | B2 * | 3/2006 | Karol et al. | 250/288 |
| 7,193,223 | B2 | 3/2007 | Franzen | |
| 2002/0092366 | A1 * | 7/2002 | Brock et al. | 73/863.32 |
| 2003/0228240 | A1 * | 12/2003 | Dwyer | 422/99 |
| 2004/0023410 | A1 * | 2/2004 | Stacey | 436/173 |
| 2004/0203175 | A1 * | 10/2004 | Li et al. | 436/180 |
| 2005/0242039 | A1 * | 11/2005 | Wall | 210/656 |
| 2006/0192107 | A1 * | 8/2006 | DeVoe et al. | 250/288 |
| 2006/0273254 | A1 * | 12/2006 | Berkout et al. | 250/288 |
| 2006/0289747 | A1 * | 12/2006 | Schultz et al. | 250/294 |

* cited by examiner

METHOD AND SYSTEM FOR DESORPTION ELECTROSPRAY IONIZATION

RELATED APPLICATIONS

This application claims priority to Provisional Application Ser. No. 60/558,352 filed Mar. 30, 2004; Provisional Application Ser. No. 60/611,934 filed Sep. 21, 2004; Provisional Application Ser. No. 60/612,100 filed Sep. 22, 2004; Provisional Application Ser. No. 60/627,526 filed Nov. 12, 2004; Provisional Application Ser. No. 60/630,365 filed Nov. 23, 2004; and Provisional Application Ser. No. 60/643,650 filed Jan. 13, 2005.

FIELD OF THE INVENTION

The present invention relates generally to the field of ionizing analytes in sample materials and, more specifically, to a method and system for ionizing analytes in sample materials at atmospheric pressure in ambient or controlled conditions, identifying the ionized analytes by chemical analysis and, if desired, imaging the source of the ionized analytes.

BACKGROUND

Development of desorption ionization techniques provided perhaps the first breakthrough in the mass spectrometric analysis of fragile, non-volatile compounds such as peptides or carbohydrates. Plasma desorption, one of the first desorption ionization methods was implemented in the mid 1970's by Macfarlane, and it was successfully used for the ionization of delicate biochemical species like toxins. Plasma desorption was followed by a number of even more successful desorption ionization methods including secondary ion mass spectrometry (SIMS), liquid secondary ions mass spectrometry (LSIMS), fast ion or atom bombardment ionization (FAB) and various laser desorption techniques. Matrix-assisted laser desorption ionization (MALDI), a member of the latter group, together with electrospray ionization has revolutionized bioanalytical mass spectrometry by making the analysis of practically any kind of biochemical species feasible. MALDI is still one of the most widely used ionization methods, and certainly the most widely used desorption ionization technique.

Besides the analysis of non-volatile species, surface profiling has become an important direction of development for desorption ionization methods. Nowadays, time-of-flight secondary ion mass spectrometry (TOF-SIMS) is one of the most versatile tools in surface science; modern systems offer submicron resolution imaging capability. While TOF-SIMS systems were originally optimized for elemental analysis, they have since been optimized also for organic analysis. The use of MALDI for molecular imaging has recently been implemented as a soft-ionization surface analysis tool capable of providing information about the spatial distribution of peptides, proteins and other biomolecules in specifically prepared tissues.

Generally, desorption ionization (DI) has been achieved in the past by particle or photon bombardment of the sample and the mass spectra obtained by different methods are somewhat similar although they vary with experimental parameters. Plasma desorption utilizes high energy (MeV range) fission fragments of $^{252}$Cf nuclides. FAB experiments are usually carried out by using high energy beams of Xe atoms. SIMS or LSIMS methods usually utilize 10-35 keV $Cs^+$ ions for surface bombardment, though theoretically any kind of ion (including polyatomic organic species such as $C_{60}$) can be used. Massive Cluster Impact (MCI) ionization, an extremely soft version of SIMS, applies high energy, multiply charged glycerol cluster ions as the energetic primary beam. Unlike other SIMS methods, MCI can give abundant multiply charged ions, and spectral characteristics much more similar to that of electrospray than to other desorption ionization methods. One low energy type of ion sputtering experiment, chemical sputtering, has also been described. Chemical sputtering is a very efficient experiment that uses low energy ions to release adsorbed molecules at a surface through an electron transfer or chemical reaction event. Laser desorption methods traditionally employ UV lasers (e.g. $N_2$ laser), however utilization of IR lasers, especially the —OH resonant Er:YAG laser ($\lambda$=2.94 μm) has become widespread recently.

In order to enhance the ionization efficiency of known desorption and ionization techniques or just simply to make the ionization of certain species feasible, the sample can be deposited onto the surface in a suitable matrix. FAB and LSIMS require the sample to be dissolved in a viscous, highly polar, non-volatile liquid such as nitrobenzyl-alcohol or glycerol. For MALDI applications the sample is cocrystallized with the matrix compound. (Theoretically the individual analyte molecules are built into the crystal lattice of the matrix compound.) MALDI matrices strongly absorb at the wavelength of the laser used, and easily undergo photochemical decomposition which usually involves production of small molecules in the gaseous state.

It was discovered recently, that certain surfaces, e.g. active carbon or electrochemically etched silicon can be used directly as laser desorption ionization (LDI) substrates because these surfaces themselves (or adsorbates on them) strongly enhance the LDI of molecules attached to them. These LDI spectra are similar to MALDI spectra, except for the absence of strong matrix peaks in the former case and the limitation to compounds of somewhat lower molecular weight than traditional MALDI.

Electrospray mass spectrometry was developed as an alternative method to DI for the analysis of non-volatile, highly polar compounds, including macromolecules of biological origin, present in solution phase. Electrospray ionization (ESI) either transfers already existing ions from solution to the gas phase, or the ionization takes place while the bulk solution is being finely dispersed into highly charged droplets. The final gaseous ion formation occurs from these multiply charged droplets by either direct ion evaporation (in the case of low molecular weight ions) or by complete evaporation of solvent from the droplets (in the case of macromolecular ions). One of the main advantages of ESI compared to other DI methods is that ESI can be easily coupled with separation methods such as liquid chromatography or capillary electrophoresis. Another advantage is that it is considerably softer than any of the other DI methods. ESI avoids the need to dry samples or to cocrystalize sample material with a matrix. A further advantageous feature of ESI is the production of multiply charged species out of macromolecular samples. This phenomenon makes macromolecular mass spectrometry feasible using practically any kind of mass analyzer including the quadrupole mass filter, the quadrupole ion trap, ICR, and magnetic sector instruments. This phenomenon of multiple charging has disadvantages too, especially in the analysis of mixtures, since the signal for one analyte is distributed into multiple charge states, which can complicate spectral interpretation. The most serious drawback of ESI compared to MALDI is the limited success of automation of the method. While average MALDI analysis time for a sample can be less than a second, in the case of ESI the shortest achievable time per analysis for a single source system is 20-40 seconds, due to carry over problems.

Although there have been recent advances in ionizing materials for mass analysis, certain unmet needs stand in the way of more widespread commercial use of such techniques. For example, a need exists for a lower-energy desorption ionization method useful in an environment other than a vacuum of the type required by SIMS. Such a desorption ionization method will fill an existing need if it functions at atmospheric pressure and in ambient (uncontrolled) conditions as well as in more controlled environments, such as those found in a laboratory or in a manufacturing facility. There is also a need for such a method that is substantially non-destructive of the sample, provides accurate results rapidly, is capable of ionizing and desorbing samples from a wide variety of surfaces and that avoids the need for pre-treating samples with, for example, a matrix material. Further, there is a need for desorption ionization-based assays sufficiently gentle to be useful on animal tissue, plant tissue and biological materials, for example in connection with in vivo testing for drug metabolites and in testing produce for pesticide residue. There is also a need for forensic assays useful in the rapid, accurate and substantially non-destructive determination of trace materials on both uncontrolled and laboratory surfaces at atmospheric pressure. A need exists for accurate, fast and minimally destructive quality control assays in manufacturing processes, including manufacturing processes in the pharmaceutical industry. There is also a need for fast, accurate clinical assays for components of body fluids such as blood, urine, plasma and saliva and for an improved assay for samples that have been subjected to preparatory separation techniques, such as gel chromatography or binding by ligans. A need also exists for fast assays of microorganisms and bacteria.

SUMMARY OF THE INVENTION

These and other needs are met by the present invention, generally referred to as Desorption Electrospray Ionization (DESI). In one aspect the invention is a method for desorbing and ionizing an analyte in a sample comprising generating a DESI-active spray and directing the DESI-active spray into contact with the sample analyte to desorb the analyte. A DESI-active spray is herein defined as a pneumatically assisted spray of fluid droplets. The DESI-active spray can be formed, for example, by an electrospray ionization device in which a gas flows past the end of a capillary from which a fluid flows to produce charged droplets of the fluid which desorb and ionize the analyte to produce analyte ions. Alternatively droplets of the fluid produced at the end of the capillary can be charged prior to contact with the analyte by, for example by using a metal needle to which a high voltage is applied. The desorbed material can also be charged to produce ions after the desorption process, by applying the same high voltage to the spray and the surface by generating a potential difference between the surface and a counter electrode (e.g. the inlet of a mass spectrometer). The spray may include neutral molecules of the atmosphere, the nebulizing gas, gaseous ions and charged or uncharged droplets of the fluid. Interaction of the spray with the analyte has been shown to result in desorption and ionization of the analyte to produce secondary ions. The resulting (secondary) ions may be analyzed to obtain information about the analyte. For example, they may be mass analyzed in a mass spectrometer. Alternatively, the resulting ions may be subjected to analysis at atmospheric or reduced pressure by ion mobility separation (IMS) followed by detection of the resulting ion current, by mass analysis of the separated species or both. The resulting ions also may be analyzed by other known systems for analyzing ions, such as flame spectrophotometers. Surprisingly, ions useful for such analysis have been produced from analytes present in samples on both conductive and insulating surfaces and from the surface of liquids at atmospheric pressure in random ambient conditions and surfaces of living organisms as well as in laboratory settings.

In another aspect, the present invention is a device for desorbing and ionizing analytes comprising a mechanism for producing and directing a DESI-active spray into contact with the analyte.

In yet another aspect, the present invention includes analysis of ions so ionized and desorbed. The invention may, optionally, also include a collector to facilitate collection of desorbed ions comprising a tube, sometimes called an ion transfer line, adapted for moving ions to the atmospheric interface of a mass spectrometer. The ion transfer line also may be combined with a DESI-active spray source such that the DESI-active spray source and the ion transfer line operate as a single element.

In still another aspect, the invention is a method for building a database useful in imaging a surface, the method comprising the steps of contacting the surface at a plurality of locations with a DESI-active spray, analyzing the ions so produced and relating the results of the analysis with the locations from which the ions were desorbed and ionized. The invention includes using the results of the analysis to generate an image of the distribution of analyte or analytes present at the surface. Further, the invention includes a method for preparing a three dimensional image of the distribution of analytes in a structure comprising successively ablating layers of the structure and generating an image of each successive layer.

In yet another aspect, the invention is a method and device for accomplishing reaction between an analyte and a reagent comprising the step of contacting the analyte with a DESI-active spray that additionally includes a reagent which reacts with the analyte.

In still another aspect, the invention is a sample support for use in holding an analyte during contact with a DESI spray, the sample support comprising a surface that is functionally modified in at least one location with a ligand for binding an analyte or for binding a reactant for an analyte.

In a further aspect, the invention is a sample holding device for positioning a sample for DESI analysis adjacent the capillary interface of a mass analyzer during such analysis. The sample holding device is normally adjustable, may be moveable to a sufficient extent to allow scanning of a sample relative to the DESI spray for imaging applications and may be adapted for holding disposable sample slides or sample supports.

In another aspect, the invention is a fluid suitable for use in forming a DESI-active spray comprising a liquid or a mixture of liquids free from the analyte and, optionally, at least one ionization promoter and, also optionally, a reactant for the analyte.

In yet a further aspect, the invention is a forensic device comprising a means for contacting surfaces under ambient conditions with a DESI-active spray at atmospheric pressure, a means for developing information about resulting desorbed ions and means for comparing the developed information with reference information about analytes.

In summary the present invention provides a process for desorbing and ionizing an analyte at atmospheric pressure whereby to provide desorbed secondary ions useful in obtaining information about the analyte.

BRIEF DESCRIPTION OF THE DRAWINGS

The foregoing and other objects of the invention will be more clearly understood from the accompanying drawings and description of the invention. The components in the figures are not necessarily to scale, emphasis instead being placed upon illustrating the principles of the invention.

FIG. 2(*b*) schematically shows a spray device for spraying large sample areas;

FIG. 3(*b*) shows a DESI-generated spectrum identifying chemical warfare stimulating agent residue desorbed at atmospheric pressure and ambient conditions from a washing nitrile glove;

FIG. 4(*b*) shows a DESI-generated spectrum resulting from a single imaging-type scan across a plant stem;

FIG. 4(*c*) shows a DESI-generated spectrum resulting from a single imaging-type scan across a tomato surface;

DETAILED DESCRIPTION OF THE PREFERRED EMBODIMENTS

The present invention is directed to a system and method for ionizing and desorbing a material (analyte) at atmospheric or reduced pressure under ambient conditions. The system includes a device for generating a DESI-active spray by delivering droplets of a liquid into a nebulizing gas. The system also includes a means for directing the DESI-active spray onto a surface. It is understood that the DESI-active spray may, at the point of contact with the surface, comprise both or either charged and uncharged liquid droplets, gaseous ions, molecules of the nebulizing gas and of the atmosphere in the vicinity. The pneumatically assisted spray is directed onto the surface of a sample material where it interacts with one or more analytes, if present in the sample, and generates desorbed ions of the analyte or analytes. The desorbed ions can be directed to a mass analyzer for mass analysis, to an IMS device for separation by size and measurement of resulting voltage variations, to a flame spectrometer for spectral analysis, or the like.

Figure 1:
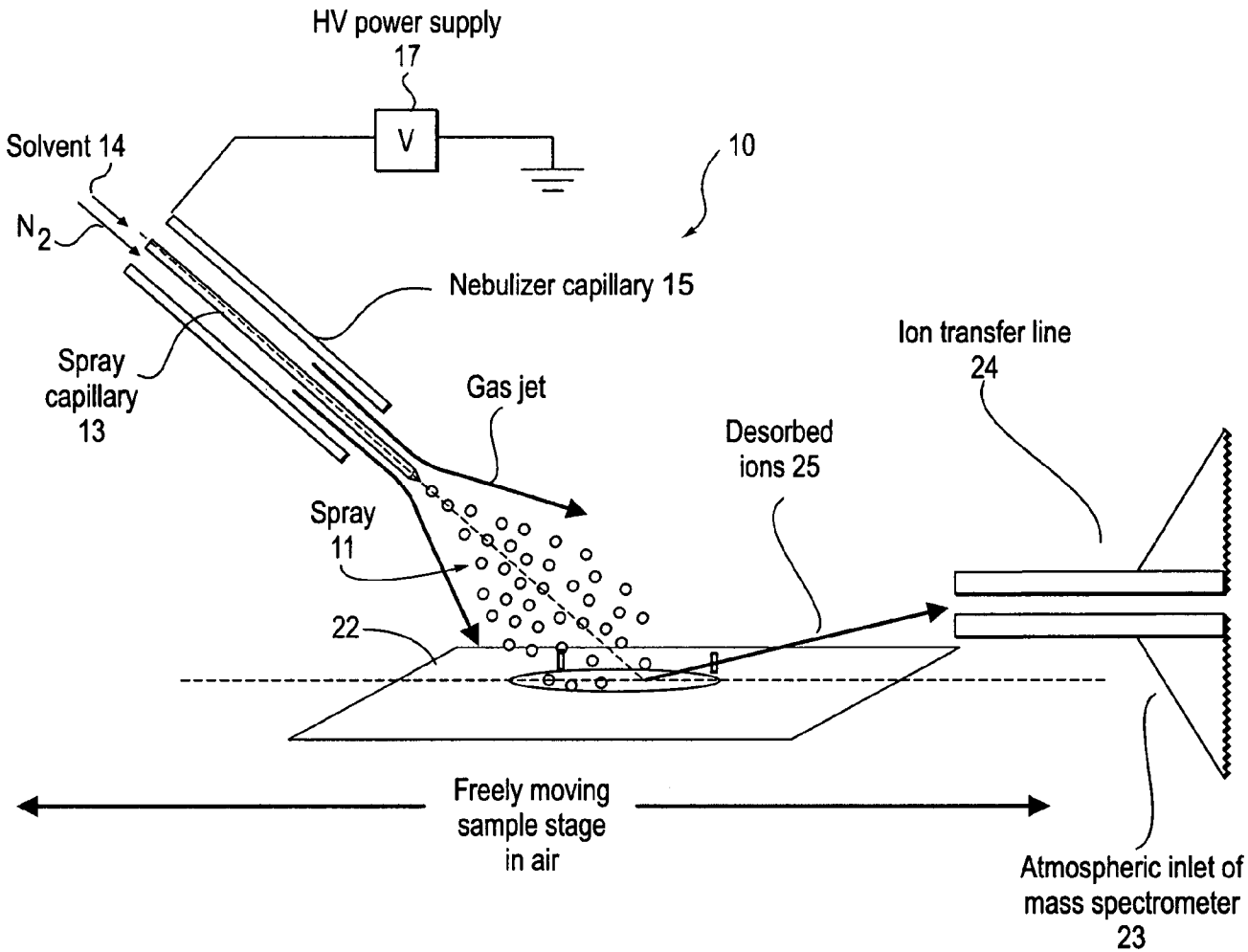
FIG. 1 schematically shows a spray device for generating and directing a DESI-active spray onto sample material (analyte) and for collecting and analyzing the resulting desorbed ions.

FIG. 1 illustrates schematically one embodiment of a system 10 for practicing the present invention. In this system a spray 11 is generated by a conventional electrospray device 12. The device 12 includes a spray capillary 13 through which the liquid solvent 14 is fed. A surrounding nebulizer capillary 15 forms an annular space through which a nebulizing gas such as nitrogen ($N_2$) is fed at high velocity. In one example, the liquid was a water/methanol mixture and the gas was nitrogen. A high voltage is applied to the liquid solvent by a power supply 17 via a metal connecting element. The result of the fast flowing nebulizing gas interacting with the liquid leaving the capillary 13 is to form the DESI-active spray 11 comprising liquid droplets. DESI-active spray 11 also may include neutral atmospheric molecules, nebulizing gas, and gaseous ions. Although an electrospray device 12 has been described, any device capable of generating a stream of liquid droplets carried by a nebulizing gas jet may be used to form the DESI-active spray 11.

The spray 11 is directed onto the sample material 21 which in this example is supported on a surface 22. The desorbed ions 25 leaving the sample are collected and introduced into the atmospheric inlet or interface 23 of a mass spectrometer for analysis by an ion transfer line 24 which is positioned in sufficiently close proximity to the sample to collect the desorbed ions. Surface 22 may be a moveable platform or may be mounted on a moveable platform that can be moved in the x, y or z directions by well known drive means to desorb and ionize sample 21 at different areas, sometimes to create a map or image of the distribution of constituents of a sample. Electric potential and temperature of the platform may also be controlled by known means. Any atmospheric interface that is normally found in mass spectrometers will be suitable for use in the invention. Good results have been obtained using a typical heated capillary atmospheric interface. Good results also have been obtained using an atmospheric interface that samples via an extended flexible ion transfer line made either of metal or an insulator.

The exact interaction which takes place between the DESI-active spray 11 and the sample 21 to generate the sample ions is not fully understood, but it appears to involve more than a single ionization mechanism. The data acquired so far leads us to believe that there are at least three ion formation mechanisms. One involves the "splashing" of charged nanodroplets onto the surface during which molecules on the surface are picked up by the impacting droplets. The droplet pick-up mechanism may be responsible for the ESI-like spectra of proteins seen in DESI spectra recorded for insulating surfaces. Evidence for this mechanism includes the strong similarity in charge-state distributions observed in these spectra and those of the same proteins examined by conventional ESI. Additonal evidence for this mechanism is the formation of enzyme/substrate complexes, which requires a minimum period of time for the constituents to spend together in solution. A second mechanism may involve charge transfer between a gas phase ion and a molecular species on the surface with enough momentum transfer to lead to desorption of the surface ions. Charge transfer can involve electron, proton or other ion exchange. The process is known from studies of ion/surface collision phenomena under vacuum. Ionization of carotenoids from fruit skin or cholesterol from metal substrates is probably an example of this mechanism. The evidence for this mechanism is indirect. These compounds are not ionized on ESI, which excludes the droplet pick-up mechanism, while the fact that the results are independent of the pH of the spray solution excludes the third mechanism (see below). A wide variety of non-volatile compounds (e.g., heavy terpenoids, carbohydrates, peptides) show high ionization efficiency at surface temperatures well above the boiling point of the sprayed solvent. In these cases the direct surface-droplet contact is unlikely due to the Leidenfrost effect. The resulting mass spectra in this temperature range do not show the multiply-charged ions characteristic of SIMS, which provides indirect evidence for a third mechanism.

The third suggested mechanism is volatilization/desorption of neutral species from the surface followed by gas phase ionization through proton transfer or other ion/molecule reactions. Increased signal intensity of certain highly basic and volatile alkaloids (e.g., coniine or coniceine) when sprayed with a 1 M $NH_3$ solution (compared to signal intensities when using 0.1% acetic acid) support this mechanism. It is believed that in most experiments, more than one mechanism will contribute to the resulting mass spectrum; however the chemical nature of an analyte, the composition of electrosprayed solvent, and physical/geometrical characteristics of the surface may determine the main mechanism responsible for ion formation.

We have found that the surfaces for supporting the sample may be either conductive or insulating. The sample may be in liquid or frozen form. DESI procedures have produced useful results when ionizing and desorbing materials from glass, metals, polymers, biological liquids, paper, leather, clothing, cotton swabs, skin, dissected plant materials and plant surfaces and material in plant and animal tissues. In laboratory settings Polytetrafluoroethylene (PTFE), Polymethylmethacrylate (PMMA) and glass have been found to be useful for supporting either dried samples or liquid samples, indicating that a wide range of polymeric materials will be useful and are intended to be within the scope of the appended claims. It is to be understood that not all of the useful materials for supporting samples in an assay have yet been fully characterized.

PMMA is presently of high interest because of its electrical characteristics and because it includes an ester that is easily fluctionalized to extract analytes of interest from complex mixtures, such as biological fluids. Although DESI has been found to be capable of identifying components in a whole blood sample, as described below, the efficiency of assays for specific analytes and the quality of the resulting data are both increased when a slide functionalized to bind with the analyte of interest is incubated with the sample prior to analysis using a DESI technique. The sample support may be functionalized with any useful binding materials or ligands including aptamers, receptors, lectins, nucleic acids, antibodies or antibody fragments, chelates and the like. A single sample slide plate may be functionalized with a variety of different ligands to create an array of sites for interrogation by a DESI process. Likewise, the DESI technology can be used to ionize and to analyze by mass spectrometry analytes that already have been separated by, for example, TLC or gel chromatography, avoiding the need for elution of an analyte from a gel or thin layer surface by wet chemistry. The efficiency of electrophoretic gel analysis by DESI may be improved by transferring the separated analytes from the gel to a more rigid surface by means of blotting and analyzing this latter surface by DESI or by mechanical scoring of the gel during or prior to analysis.

In a simple experiment using an electrospray device as described above, an insulating surface known to support a specific sample was contacted with the DESI-active spray. Ions collected from near the surface were confirmed by mass spectrometry to include those of the sample. In a modification of this experiment, the system of the present invention was brought into contact with a liquid known to contain a specific analyte. Ions collected from near the surface of the liquid were confirmed by mass spectrometry to include those of the known sample.

As in the experiment described above, the gaseous ions produced from the sample can be directed into a mass spectrometer for analysis. Sample materials that also provide spectra when ionized by ESI have been found to provide similar spectra when ionized by the DESI process. For example, the DESI spectrum of lysozyme was found to contain a series of multiply charged ions corresponding to the addition of various numbers of protons to the molecule. Not only the general characteristics, but even the observed charge states are similar to the charge states observed in electrospray ionization.

Figure 2A:
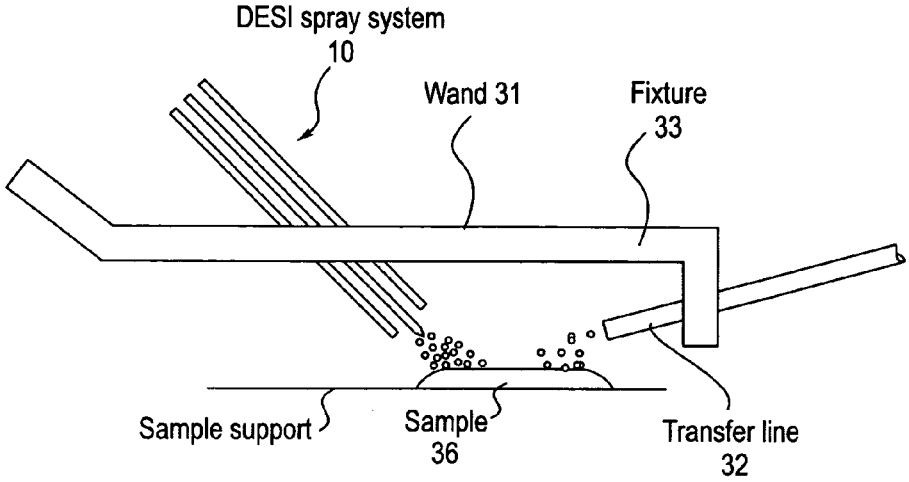
FIG. 2(*a*) schematically shows a spray device or wand which includes a sampling capillary.

In one embodiment, a flexible ion transfer line is combined in a wand-like tool with the source of the DESI-active spray. The wand/transfer line combination may take a variety of forms, including an arrangement that holds the collector line 25 and the DESI-active system 10 in an orientation substantially the same as the orientation of the separate components that are shown in FIG. 1. One embodiment of a suitable wand 31 is shown in FIG. 2*a*. The wand 31 may include a DESI systems 10 and capillary ion collection tube or ion transfer line 32 supported by a fixture 33. The DESI-active spray 11 is directed onto a small area or region of the sample 36 and the desorbed and ionizes analyte from this small area are picked up by the ion transfer line 32 for transfer to the mass analyzer. This permits moving the wand 31 to apply spray and desorbs and ionizes different areas of a sample 36.

Figure 2B:
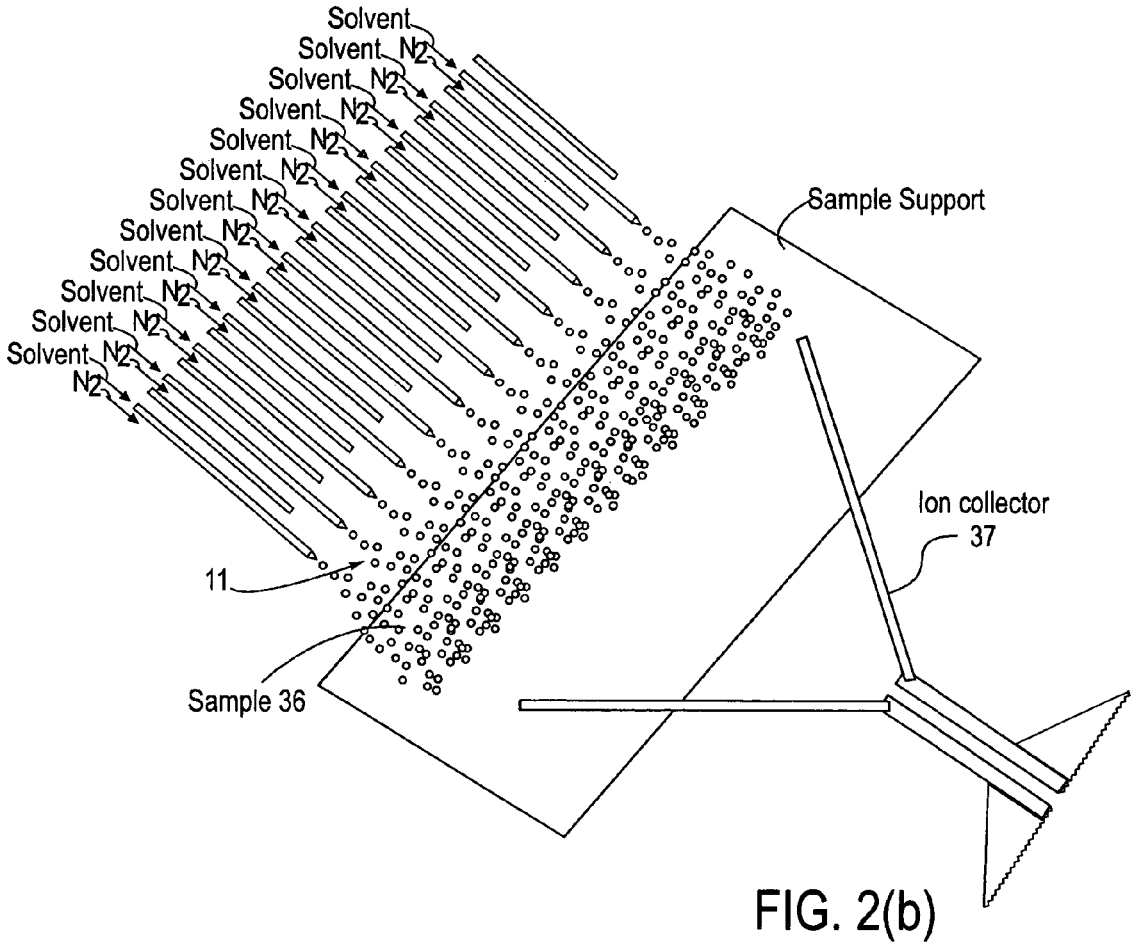

Although the wands of FIG. 2*a* is suitable for embodiments with a single DESI system 10 and a single collection capillary, they are readily adaptable to configurations for sampling relatively large surfaces, such as suitcases and clothing. FIG. 2*b* shows in schematic top view of such an embodiment in which a plurality of DESI systems 10 provide DESI-active spray to a wide area and the desorbed and ionizations are collected by collector 37 for analysis.

In a typical laboratory operation of the device of FIG. 1, sample solution (1-5 μl) was deposited and dried onto a PTFE surface. Methanol-water (1:1 containing 1% acetic acid or 0.1% aqueous acetic acid solution) was sprayed at 0.1-15 μL/min flow rate under the influence of a 4 kV voltage. The nominal linear velocity of the nebulizing gas was set to about 350 m/s. These parameters were used in several of the examples, below that refer to the device of FIG. 1.

Comparisons of the sensitivity of the DESI method with that of MALDI were made by assaying for lysozyme using the Finnigan LTQ for DESI analysis and using a Bruker Reflex III instrument for MALDI. Detection limits for lysozyme were in the range of 10-50 pg for both techniques using these particular instruments.

Sensitivity of DESI in its current state of development was determined for reserpine, bradykinin and lysozyme, all three being deposited onto a PTFE surface. Limits of Detection (LOD's) (corresponding to 3:1 signal to noise ratio) were 200 pg, 110 pg, and 10 pg, present in the area exposed to the DESI-active spray, respectively. In these experiments 0.2 μl aqueous sample solution was deposited and dried onto the surface giving 1.1 mm diameter spots. Sampled area was ~3 $mm^2$ in this case and completely included the deposited spot. Sprayed liquid was methanol/water 1:1 containing 0.1% acetic acid. Other conditions are shown in Table 1.

Factors influencing the ionization efficiency and spectral characteristics of DESI are presently believed to be the spray conditions (i.e., the liquid sprayed, its pH, the applied voltage, and the gas flow rate), the impact angle of the spray to the surface, and the spray tip-to-surface distance. The conditions summarized in Table 1 have been found to be efficient start-up settings that are largely independent of the sample material (analyte) and that can be fine tuned. It is anticipated that a wide range of settings will be found by artisans to be useful in various DESI applications.

TABLE 1

Useful operating conditions for recording DESI spectra

| Parameter | Optimal Setting |
|---|---|
| Sample-MS inlet (AP interface) | 30 cm length |
| Electrospray voltage | >3 kV |
| Electrospray flow rate | 5 μl/min |
| Nebulizing gas linear velocity | 350 m/s |
| MS inlet-surface distance | 2 mm |
| Tip-surface distance | 5 mm |
| Incident angle (α in FIG. 1) | 50 degrees |
| Collection angle (β) | 10 degrees |

As described above, a broad range of analytes has been examined, from simple amino acids through drug molecules to proteins on a variety of surfaces. The examination confirms the applicability of the DESI technique to research, clinical chemistry, point-of-care testing, and the like, using dried or liquid samples on a variety of surfaces, including arrays. The following are examples of the use of a DESI system for analysis of various analytes:

EXAMPLE 1

Figure 3A:
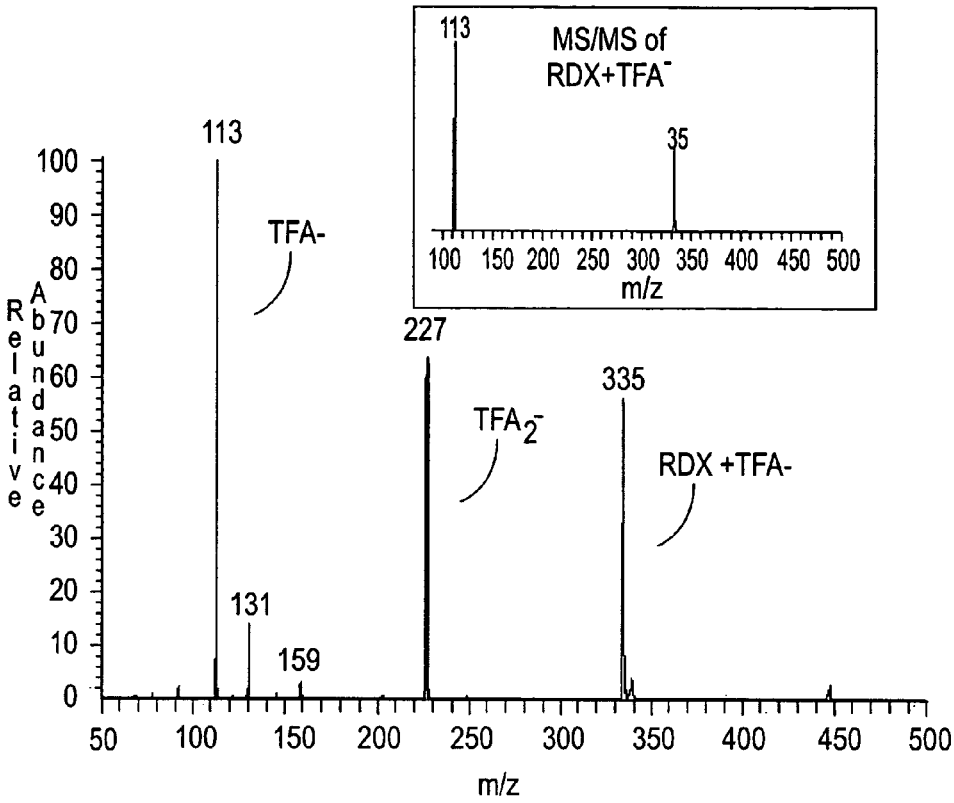
FIG. 3(*a*) shows the DESI-generated spectrum identifying RDX, an explosive agent, desorbed from the surface of a leather glove at atmospheric pressure and ambient conditions.
Figure 3B:
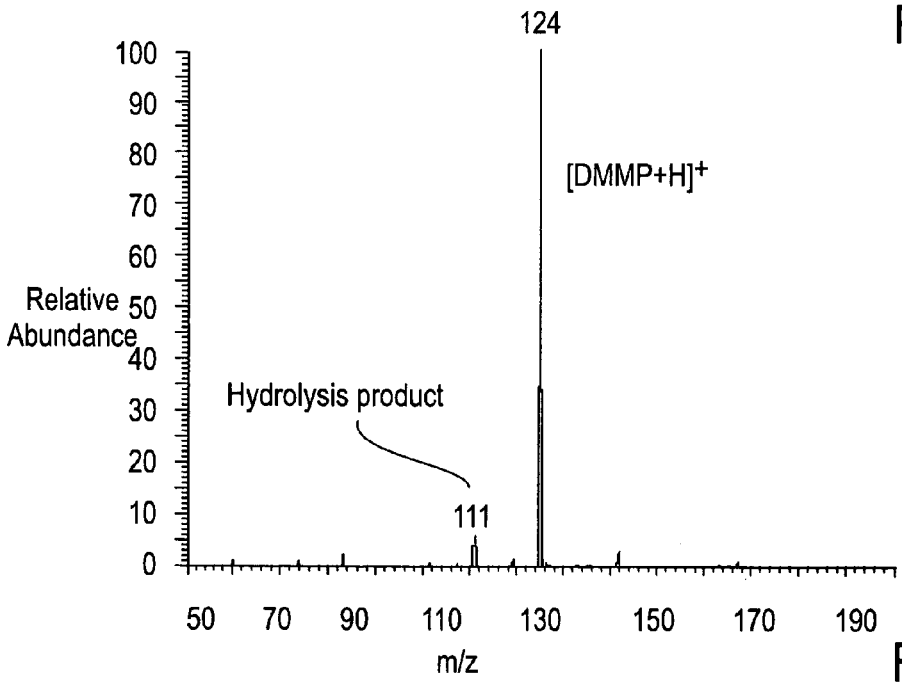

The promise of the DESI device and method for use in forensic and public safety applications, such as detecting explosives and chemical agents on ambient (uncontrolled) surfaces is illustrated here by two experiments, In one experiment the explosive RDX was desorbed from an insulating tanned leather (porcine) surface, to give a negative ion DESI spectrum (FIG. 3(*a*)) of 1 ng/$mm^2$ RDX using acetonitrile (ACN)/methanol (MeOH)/trifluoroacetic acid (TFA) 1:1:0.1% as solvent). The presence of the explosive in the spectrum was confirmed by tandem MS (inset).

EXAMPLE 2

In a second experiment, nitrile gloves exposed for less than a second to dimethyl methylphosphonate vapors (DMMP is a chemical warfare agent stimulant), followed by washing and drying, gave a mass spectrum, shown in FIG. 3(*b*), that unequivocally indicates the presence of trace levels of DMMP. Positive ion DESI spectrum of DMMP was obtained using acetonitrile (ACN)/methanol (MeOH)/trifluoroacetic acid (TFA) 1:1:0.1% as solvent. Examples 1 and 2 also illustrate DESI-active sprays that include a material that can react with the sample in such a way that measurable ionic species of a reaction product are formed and desorbed.

EXAMPLE 3

Figure 4A:
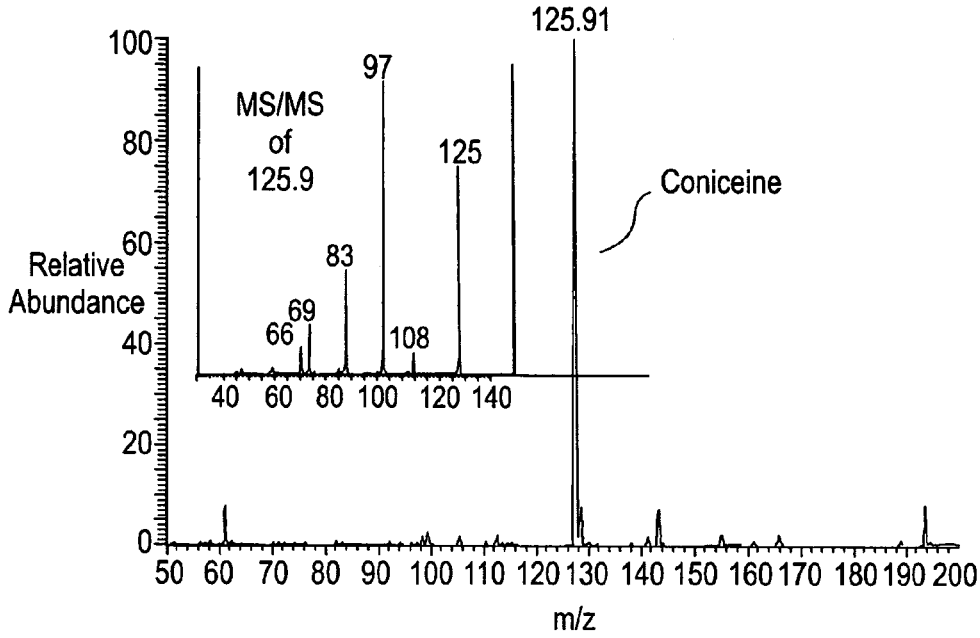
FIG. 4(*a*) shows a DESI-generated spectrum identifying an alkaloid in a plant seed.
Figure 4B:
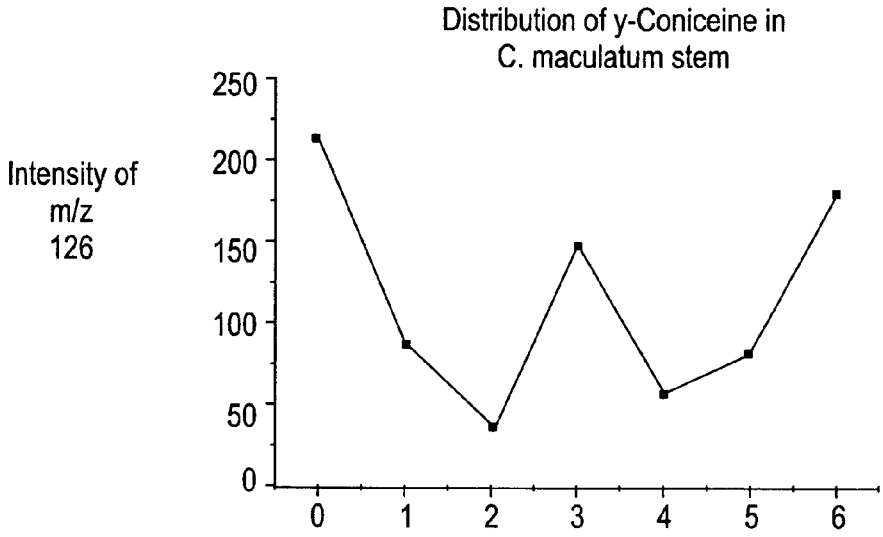
Figure 4C:
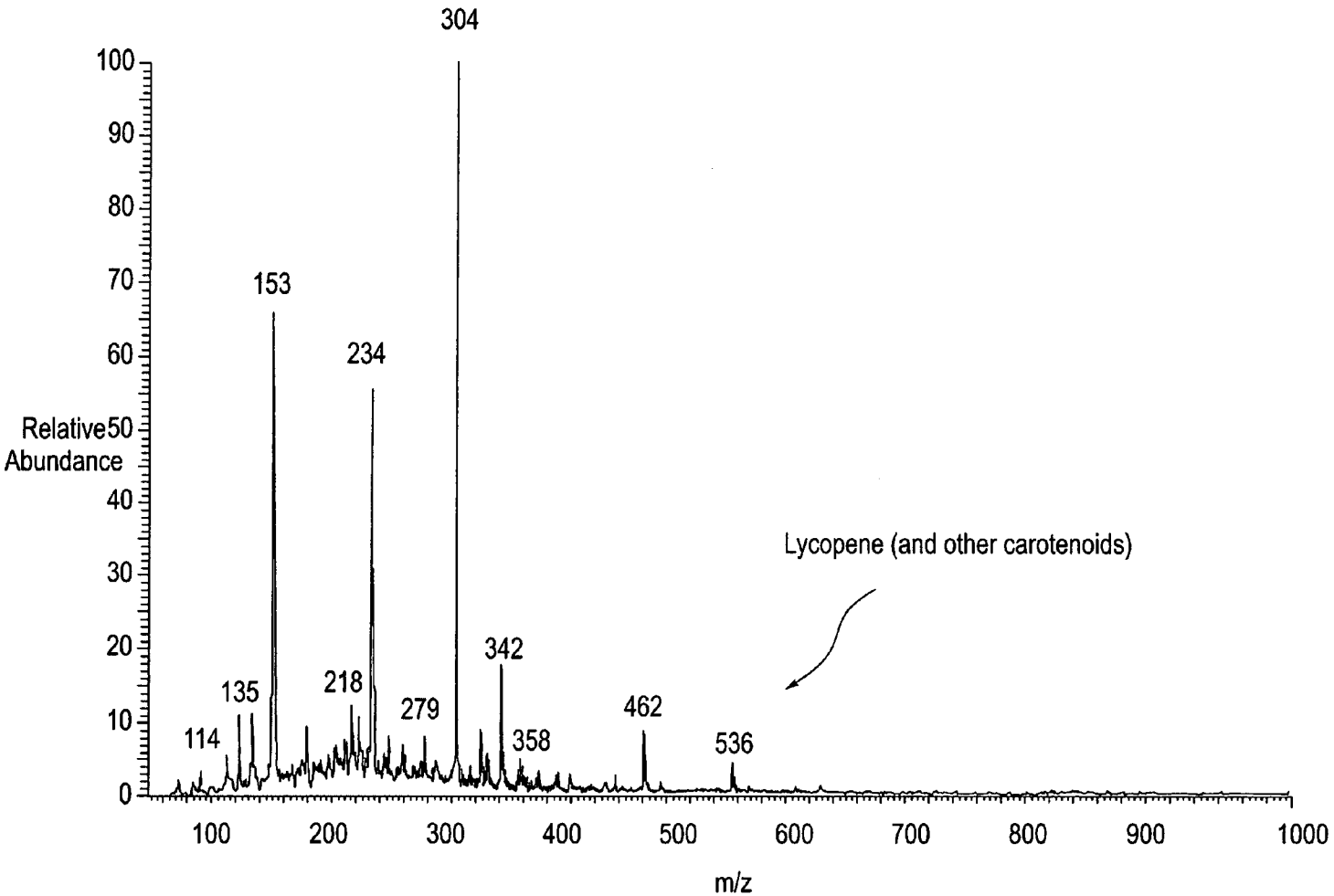

Conium maculatum seed was sectioned and held under ambient conditions in the device shown in FIG. 1. Methanol/water was used to create a DESI-active spray that was sprayed onto the seed, and desorbed ions were transferred to an ion trap mass spectrometer. FIG. 4(*a*) shows the resulting positive DESI ion spectrum. The signal at m/z 126 corresponds to protonated γ-coniceine (molecular weight 125), an alkaloid present in the plant. The DESI-active spray and a wand-like ion collection line for moving ionized and desorbed material to the mass spectrometer were rastered across a section of conium maculatum stem. FIG. 4(*b*) shows the intensity distribution of m/z 126 across the stem cross section. The DESI-active system also was rastered across a portion of tomato skin and the resulting ionized material was collected and introduced into an ion trap MS via a metal ion transport tube. The resulting spectrum is shown in FIG. 4(*c*).

Quantitative results can be obtained by using appropriate internal standards in experiments, where the sample is pre-deposited on a target surface; however, quantification by any method is intrinsically difficult in the analysis of natural surfaces. Sprayed compounds used as internal standards yielded semi-quantitative results (relative standard deviation values of ~30%) for spiked plant tissue surfaces.

The results of Example 3 demonstrate the usefulness of the present invention in non-destructively detecting naturally occurring organic material on plant surfaces. The results also demonstrate the usefulness of the present invention in obtaining data that can be used in imaging the distribution of material on surfaces or in biological molecules typified by the opened seed.

EXAMPLE 4

Figure 5:
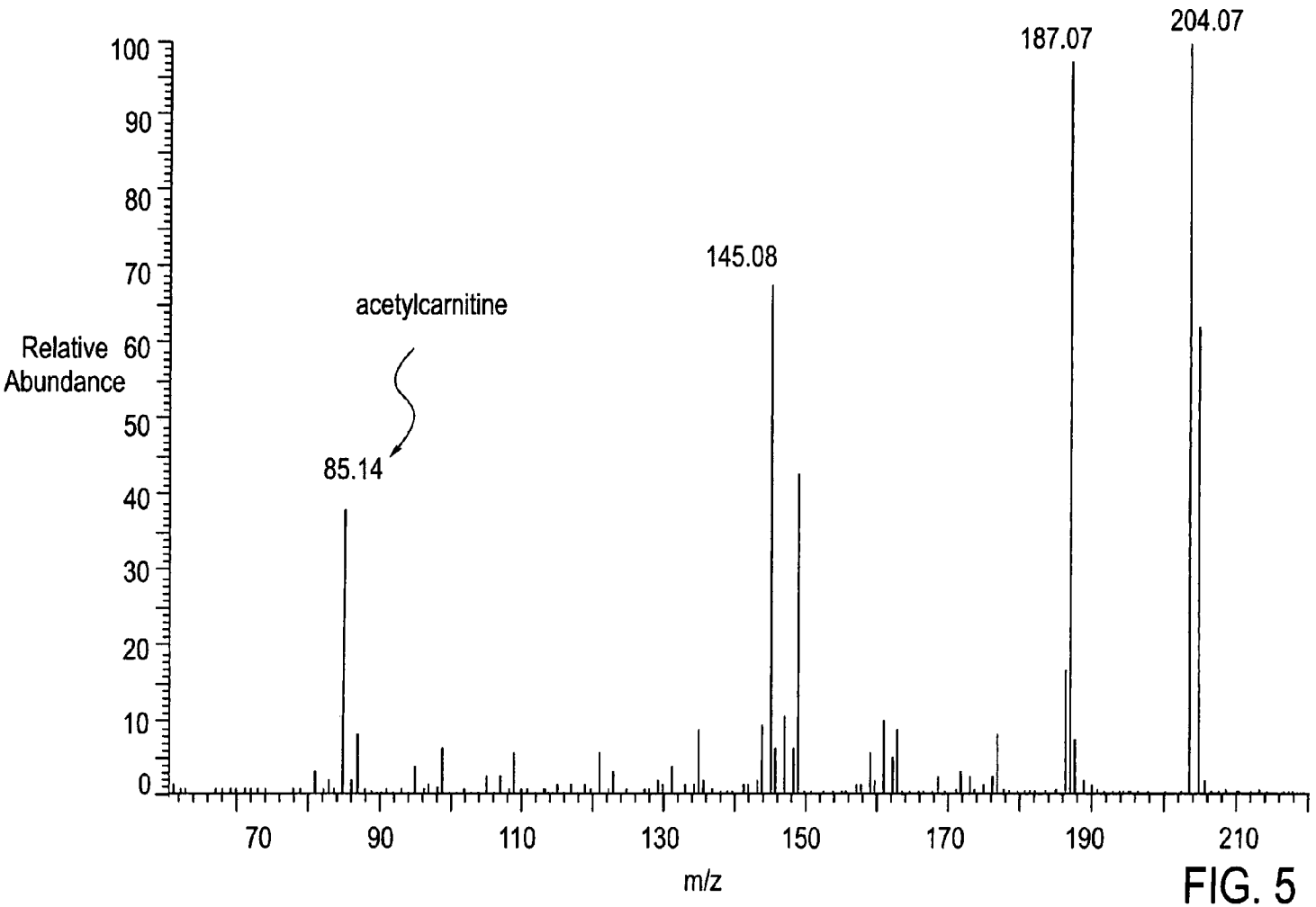
FIG. 5 shows a DESI-generated spectrum of a bleeding wound in human subject and confirms the presence of expected components.

Freshly prepared tissue was positioned in a DESI-active spray, such as that illustrated in FIG. 1, to subject the tissue to a spray of ethanol/water 1:1 solution, resulting in the spectrum of FIG. 5. Although the spectrum includes many abundant ions, the MS/MS product ion spectra of those ions of m/z 162 and m/z 204 clearly confirm the presence of camitine and acetylcamitine in the tissue. The data disclosed in Example 4 confirms the usefulness of the invention in the analysis of body fluids, tissue, etc.

EXAMPLE 5

Figure 6A:
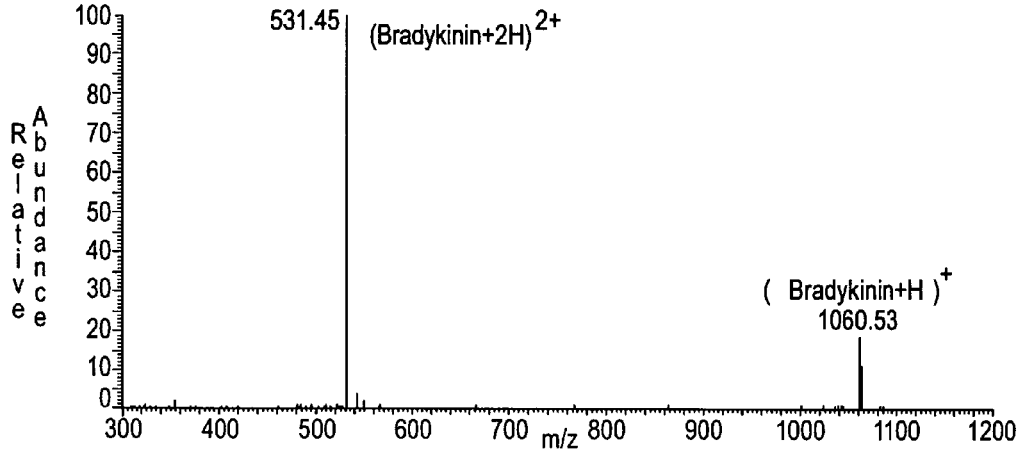
FIGS. 6(*a-c*) shows DESI-generated spectra typical of amino acids and proteins desorbed from surfaces.
Figure 6B:
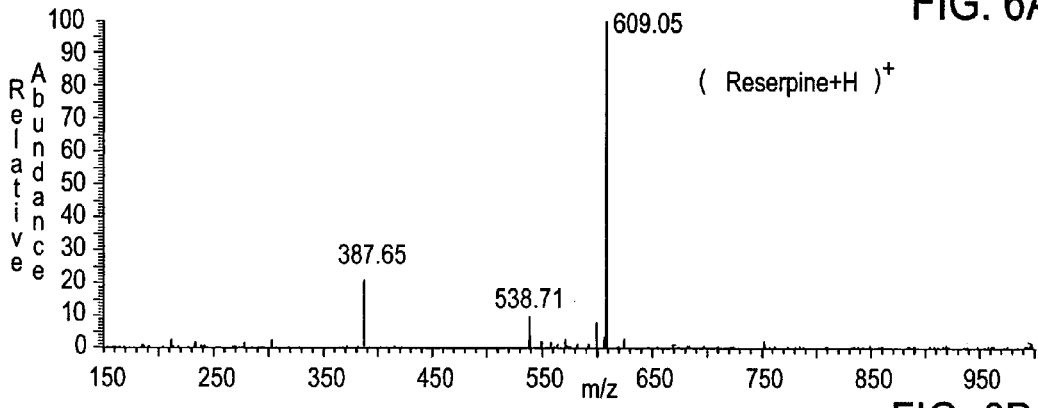
Figure 6C:
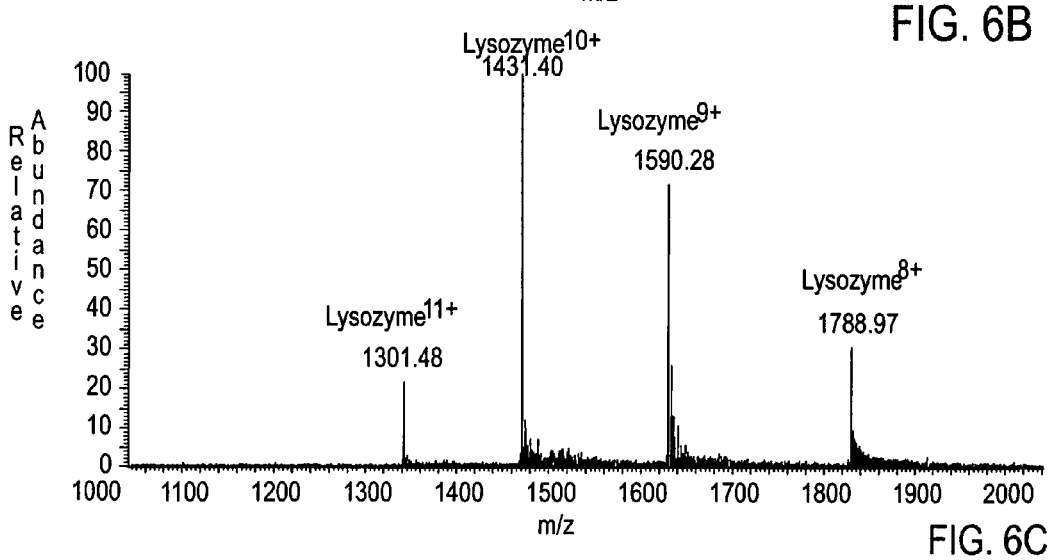

A broad range of analytes was tested, ranging from simple amino acids through drug molecules to proteins, and these analytes were present in samples of a wide variety of complexity. A few representative DESI spectra are shown in FIGS. 6(*a-c*). The observed charge state distributions and the narrowness of the peaks lead to the conclusion that DESI spectra of the compounds examined are very much like the ESI spectra recorded when analytes are dissolved in the same solvent systems and then sprayed.

FIG. 6(*a*) shows DESI mass spectrum of the peptide bradykinin present on a PTFE surface at an average surface concentration of 10 ng/$cm^2$. Methanol/water was sprayed onto the surface and desorbed ions were sampled using a Thermo Finnigan LTQ mass spectrometer. The m/z 531 ion represents the doubly-charged molecular ion of bradykinin, while the m/z 1061 ion is the singly-charged molecular ion.

FIG. 6(*b*) shows DESI spectrum of reserpine ions desorbed from a PTFE surface where the average surface concentration was 20 ng/$cm^2$.

FIG. 6(*c*) shows DESI spectrum of lysozyme was desorbed from PTFE surface where the average surface concentration 50 ng/cm$^2$. Ions having m/z ratios of 1301, 1431, 1590 and 1789 are the +11, +10, +9 and +8 charge states of lysozyme.

EXAMPLE 6

Figure 7:
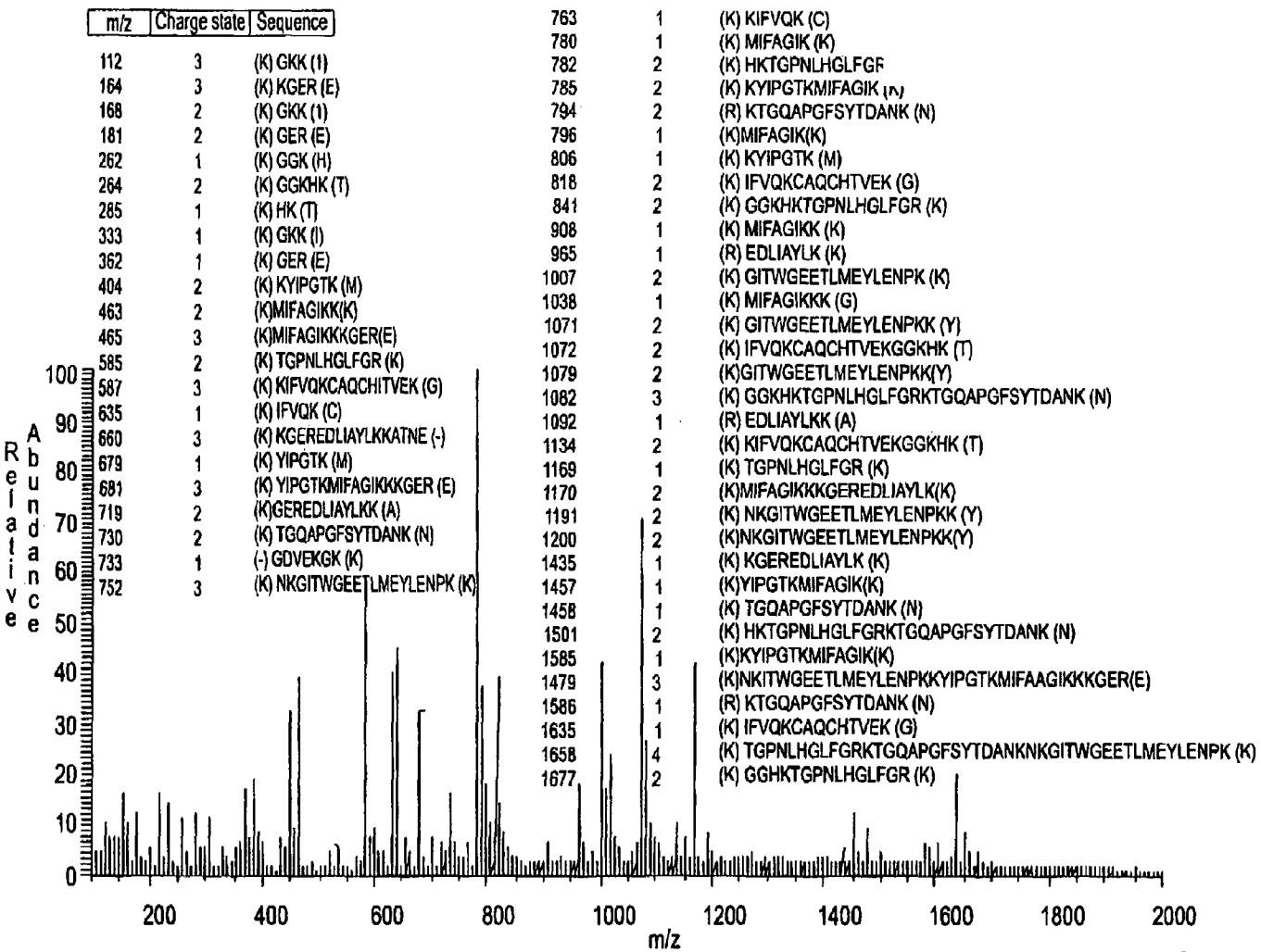
FIG. 7 shows a DESI-generated spectrum for bovine cytochrome C ionized from a solid surface.

The potential value of DESI for identifying biological compounds is indicated by the mass spectrum of the tryptic digest of bovine cytochrome C, shown in FIG. 7. More than 60% of the possible tryptic fragments were observed in the spectrum, and this makes the identification of the protein feasible via a database search. FIG. 7 shows positive ion DESI spectrum of a tryptic digest (1 mg/cm$^2$) of bovine cytochrome C produced by the device of FIG. 1.

EXAMPLE 7

Figure 8:
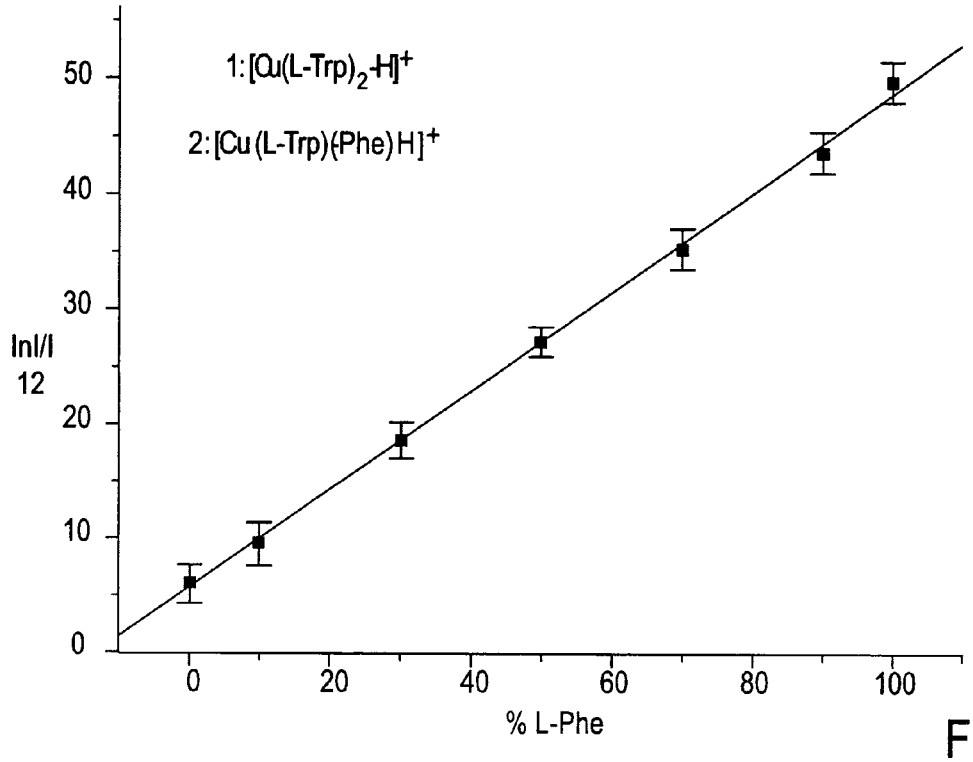
FIG. 8 shows the usefulness of the present invention in identifying enantiomeric compositions.

Applicability to non-covalent complexes and other delicate structures is indicated by the DESI spectrum of L-serine, which yields the protonated magic number octamer of the amino acid. Enzyme/substrate, enzyme/inhibitor or antigen/antibody interactions can also be preserved, e.g. acetyl chitohexaose solution sprayed onto lysozyme present on a PTFE surface yielded the enzyme substrate complex at m/z 1944 and 2220. Specific complexes also can be generated between the analyte on the surface and ligands introduced into the spray solution. There are many uses for this, including an experiment in which the enanatiomeric composition (chirality) of a specific compound originally present on a surface is measured. A gaseous metal-cation bound complex ion, which contains two molecules of an enantiomerically pure reference compound and one analyte molecule, is formed, mass-selected and fragmented by collision-induced dissociation (CID). The enantiomeric composition is measured by comparing the intensities of primary fragment ions in a kinetic method procedure. Using phenylalanine as analyte, L-tryptophan as the reference, and Cu(II) as the metal center, a linear relationship is seen (FIG. 8) between the natural logarithm of the ratio of primary fragment ion intensities and the percentage of L-phenylalanine present in a sample, which allowed quantitative chiral determinations of alanine samples of unknown enantiomeric purity. This particular experiment has a wide area of potential applications, from archeology (age determination), through pharmaceutical applications (quality control), to astrobiology.

EXAMPLE 8

Figure 9A:
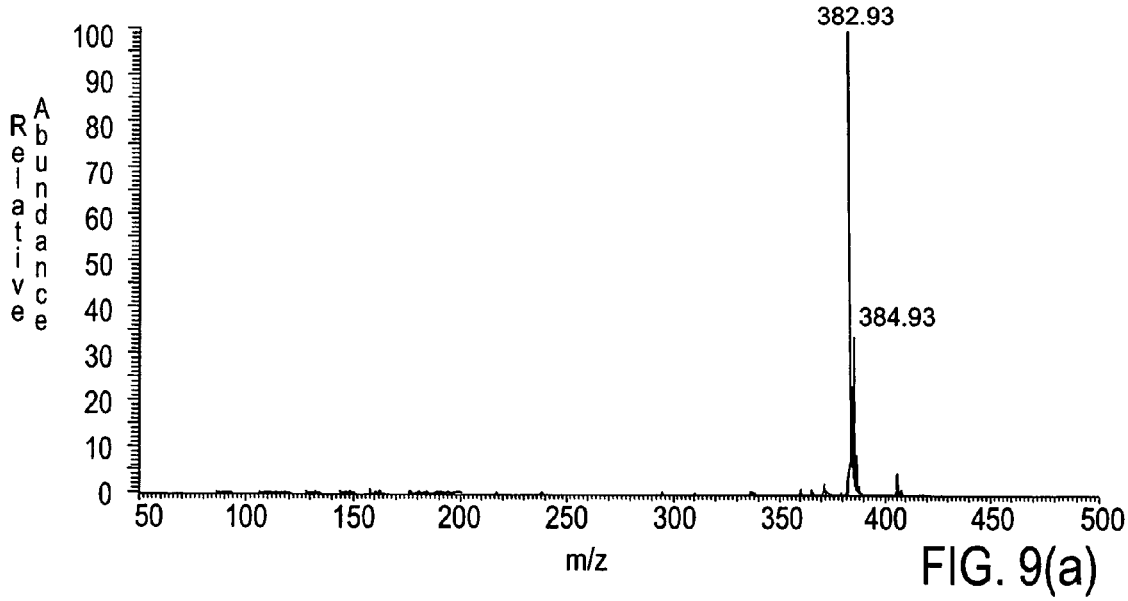
FIGS. 9(*a-c*) show DESI-generated spectra of ions desorbed from the surface of a pharmaceutical tablet.
Figure 9B:
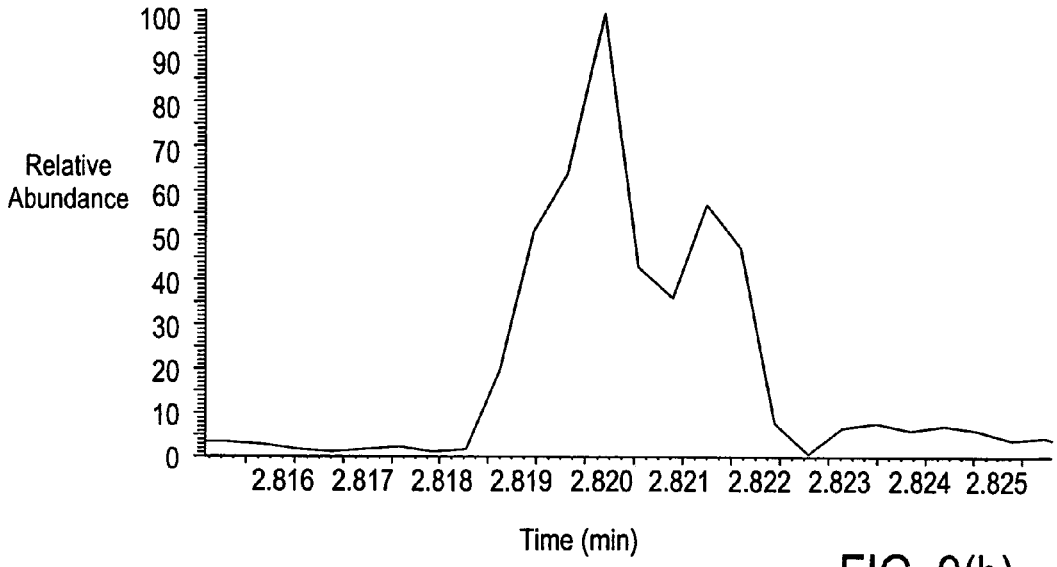
Figure 9C:
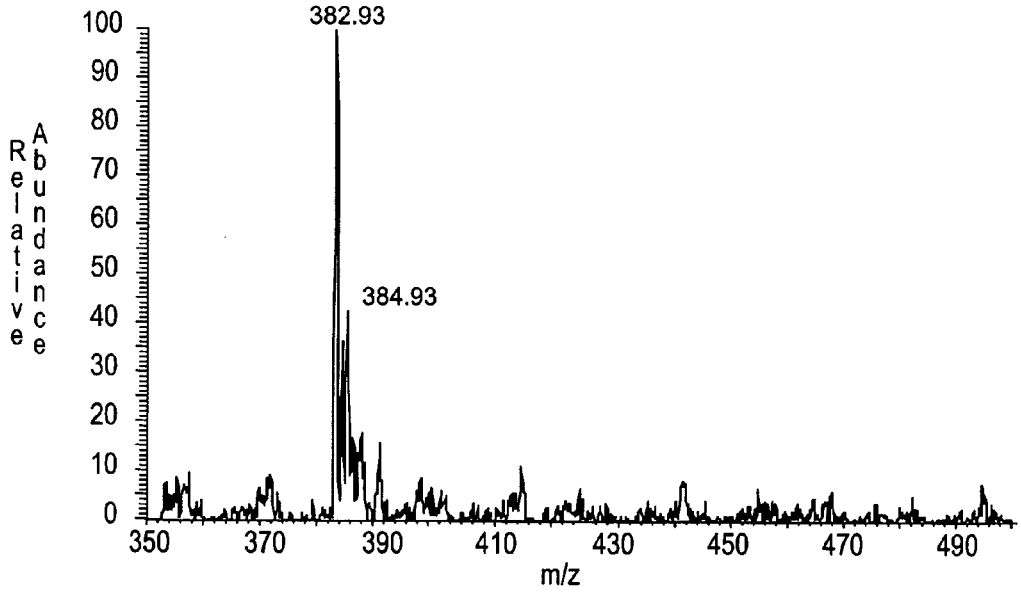

The capability of DESI to rapidly examine a large number of samples was tested by analyzing a drug molecule (loratadine) directly from tablets. A typical spectrum of Claritine® (Schering-Plough) tablet is shown on FIG. 9(*a*). The weight loss of the tablet after 1 second exposure to methanol/water spray was less than 0.1 mg and there was no visible trace of the analysis. The chromatogram and obtained spectrum shown on FIGS. 9(*b*) and 9(*c*) show that the analysis time for one sample can be as low as 0.05 sec.

EXAMPLE 9

Figure 10:
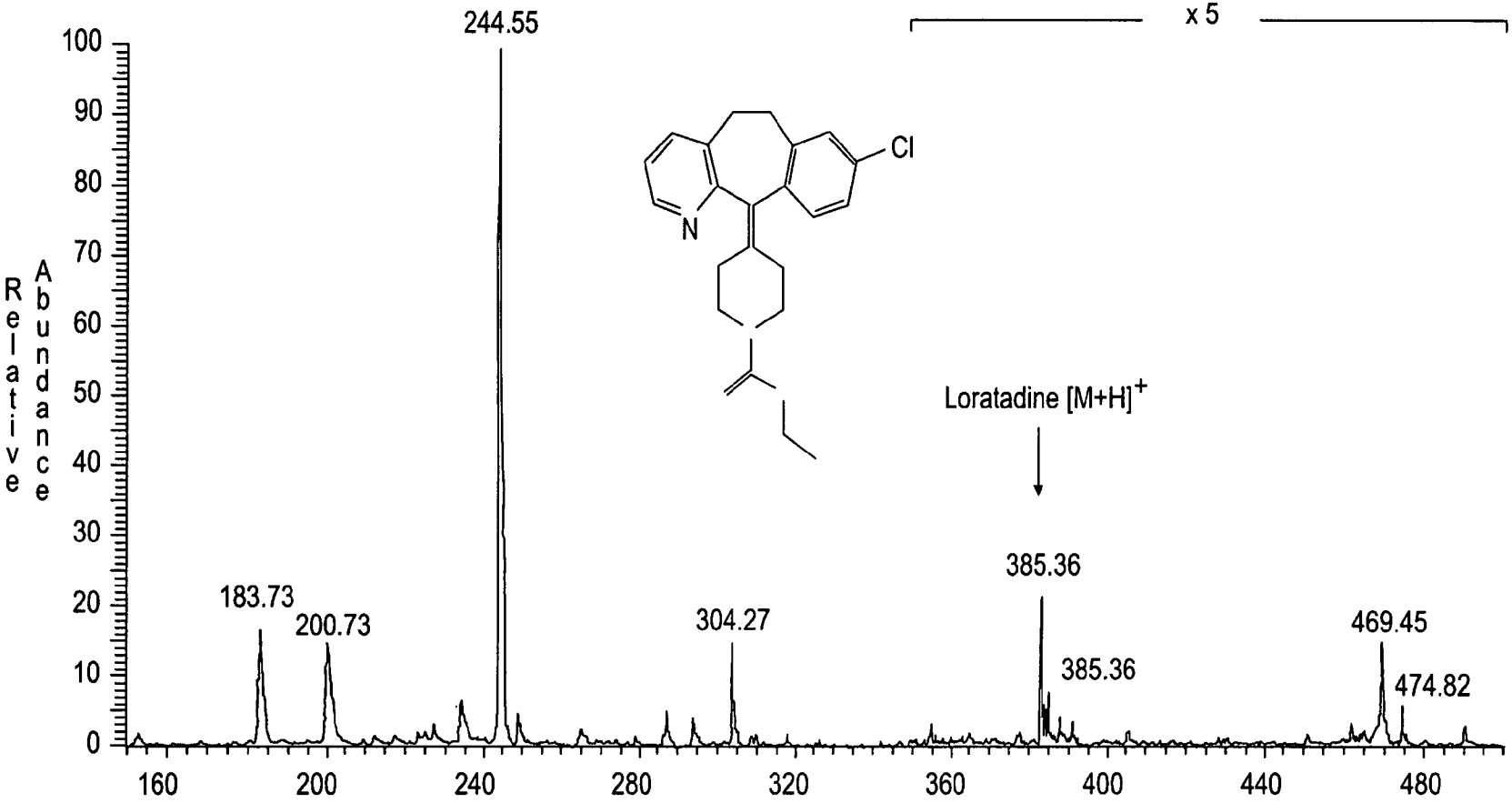
FIG. 10 shows a DESI spectrum that confirms the presence of drug metabolites on the skin of the subject.

A stream of charged methanol-water droplets was sprayed onto the finger of a subject 50 minutes after ingesting 10 mg. of over-the-counter antihistamine Loratadine (m/z 383/385). The antihistamine was ingested with care to avoid leaving traces on the subject's fingers. As shown in FIG. 10, the presence of Loratadine was seen in a DESI spectrum when materials were ionized from the subject's finger and were collected in an ion trap MS and measured. The Loratadine ions are believed to be a metabolite originating from the ingested antihistamine. Skin has also been tested in this way to find other drug molecules and their metabolites as well as metabolites of food components such as caffeine, theobromine, menthol, and the like. Materials found on the skin of subjects under less controlled conditions include urea, amino acids, fatty acids, uric acid, creatinine, glucose and other organic compounds. The data described in this example indicate the usefulness of the present invention for in vivo dosage monitoring of pharmaceuticals, drugs-of-abuse testing, and the like.

EXAMPLE 10

Figure 11:
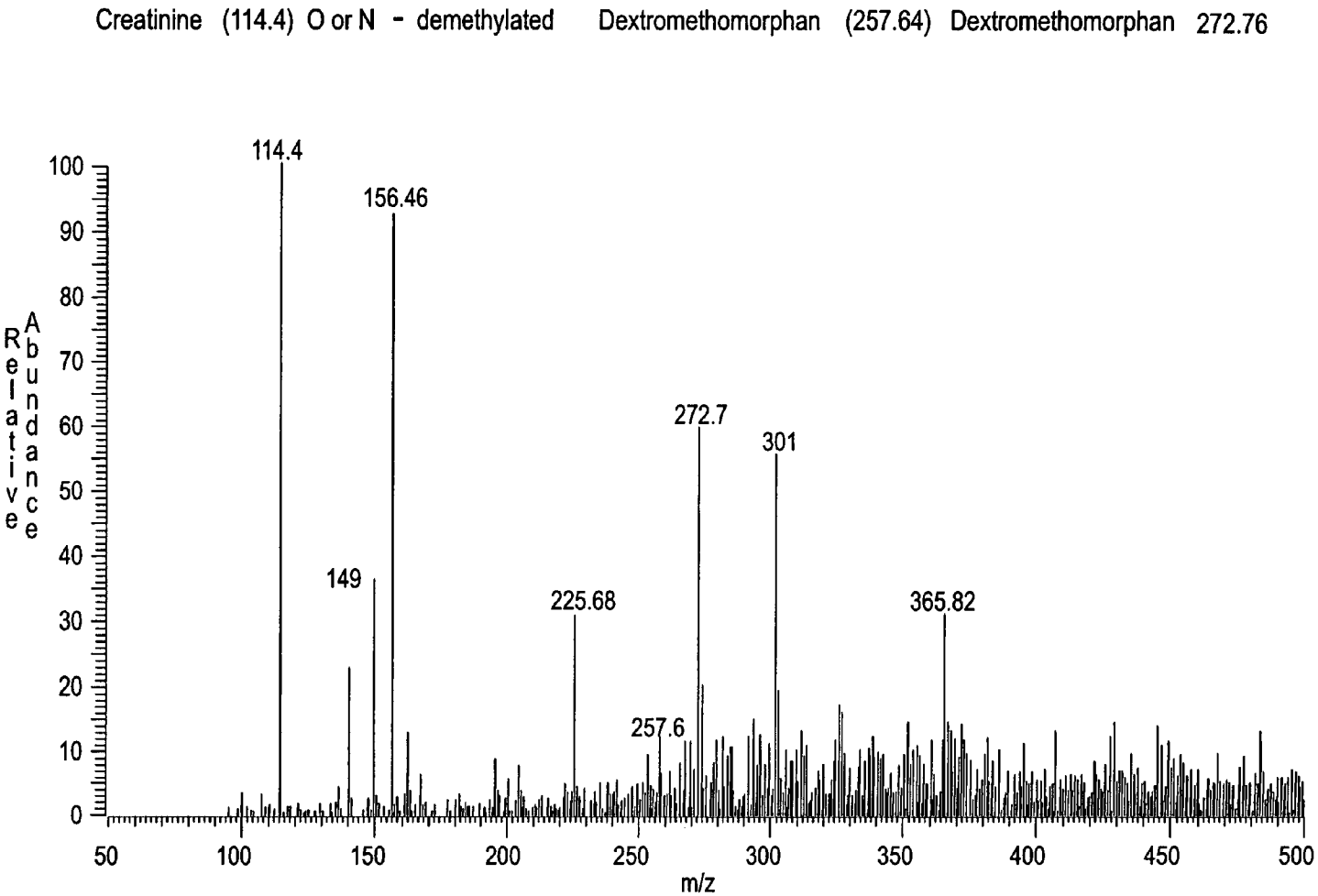
FIG. 11 shows the detection of drugs and drug metabolites in urine by means of the present invention.

In another assay for metabolites, a drop of urine collected about 40 minutes after a subject ingested two tablets of Alka-Seltzer Plus Flu medicine was placed on a surface and subjected to a stream of charged methanol-water droplets. The resulting ions were trapped and analyzed by mass spectroscopy resulting in the spectra shown in FIG. 11. The spectra included peaks for Dextromethorphan (272.76), known to be present in the medicine and for O or N-demethylated Dextromethorphan (257.64), a metabolite of the Dextromethorphan. A peak for creatinine (114.41), a normal constituent of urine, was also identified.

EXAMPLE 11

Figure 12A:
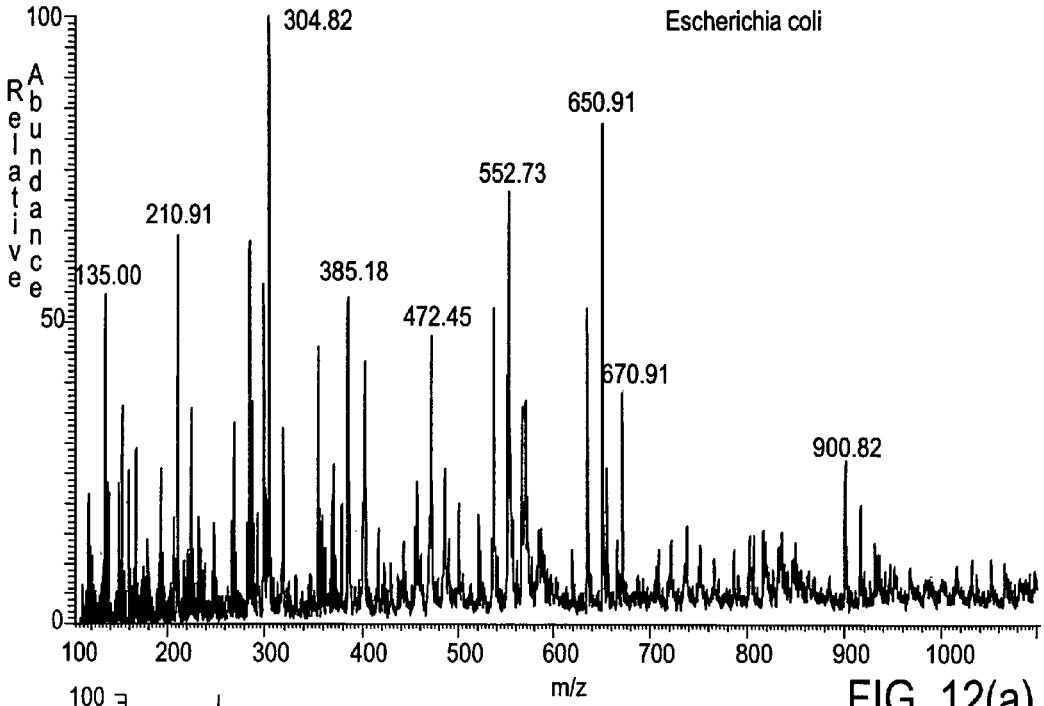
FIGS. 12(*a-c*) shows the fingerprinting or mapping of bacteria by means of the present invention.
Figure 12B:
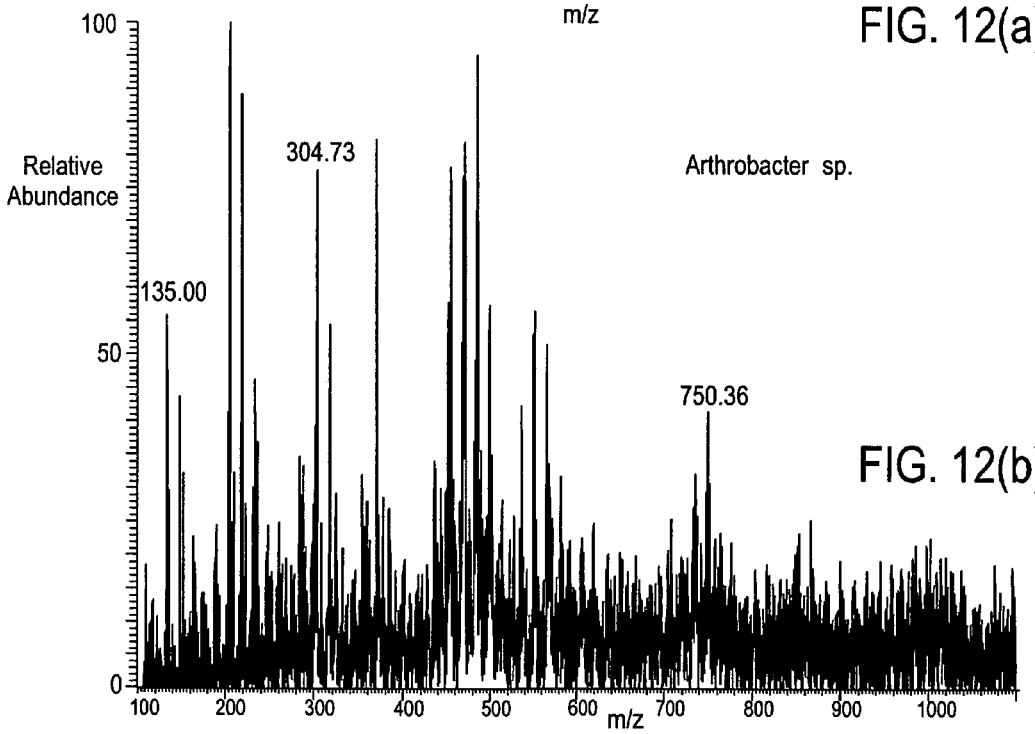
Figure 12C:
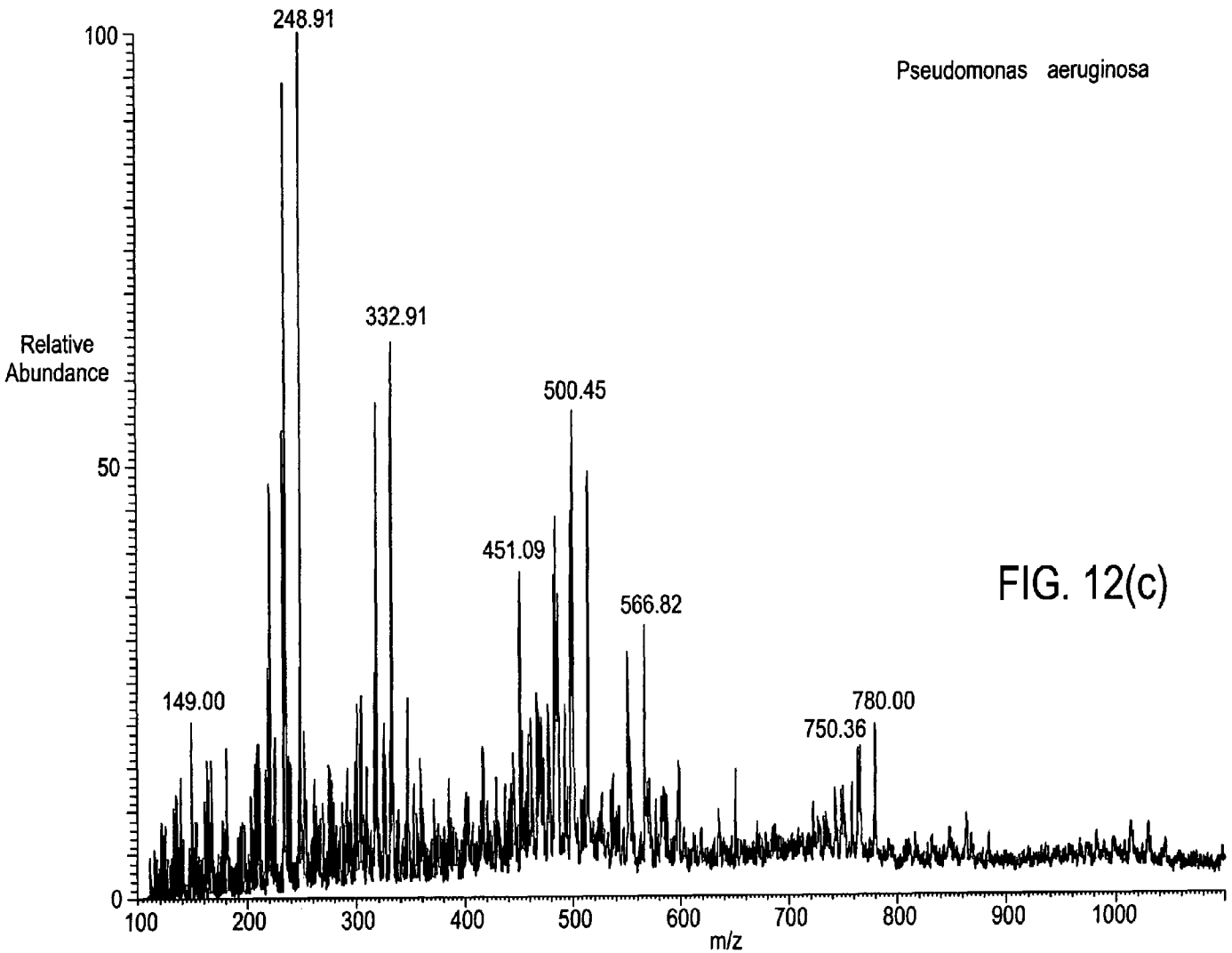

The usefulness of the present invention in mapping or "fingerprinting" the components of targets of interest, such as bacteria, was demonstrated by drying about 1 mg of bacterial cells (grown for 24 hours on LB agar) on a PTFE surface and subjecting the dried cells to a stream of charged methanol/water droplets. Ionized material from the dried bacterial cells were collected and analyzed in a Thermo Finnigan LTQ mass spectrometer. "Fingerprints" for *Escherchia coli, Arthrobacter* sp. and *Pseudomonas aeruginosa* were thus produced and are shown in FIGS. 12*a*, 12*b* and 12*c*, respectively.

Areas of application of DESI to mass spectrometry are emerging from such simple sampling procedures. In particular, process analysis and other high throughput experiments are much simplified over standard mass spectrometric methods, and initial experiments with pharmaceuticals show that analysis rates of 20 samples/sec can be achieved.

Both MALDI and SIMS, can be used to image biological materials, but experiments using MALDI and SIMS are done in vacuum. Atmospheric pressure matrix assisted laser desorption ionization (AP-MALDI) and atmospheric pressure laser ablation have been used for non-vacuum imaging of biological materials; however in both of these methods the sample is strictly positioned relative to the ion source and is inaccessible and not manipulated during the experiment. Working under ambient conditions, DESI can be used for the analysis of native surfaces, for instance to image plant or animal tissues for particular compounds. The potential for this type of application is illustrated by the DESI spectrum of a leaf section of Poison Hemlock (Conium maculatum), shown in Example 3. The peak at m/z 126 in FIG. 4 is due to coniceine, known to be present in this particular plant species. The possibility of in-situ imaging was demonstrated by scanning the spray spot across a cross section of the plant stem (FIG. 4(*b*)). Similarly, the DESI spectrum collected from tomato (lycopersicon esculentum) skin also indicates the localization of characteristic compounds including lycopene at m/z 536 (FIG. 4(*c*)). Because DESI is carried out in air, it is the first mass spectrometry technique that clearly has the capability of allowing in-vivo sampling and imaging on living tissue surfaces as is shown in connection with Example 5.

Figure 13:
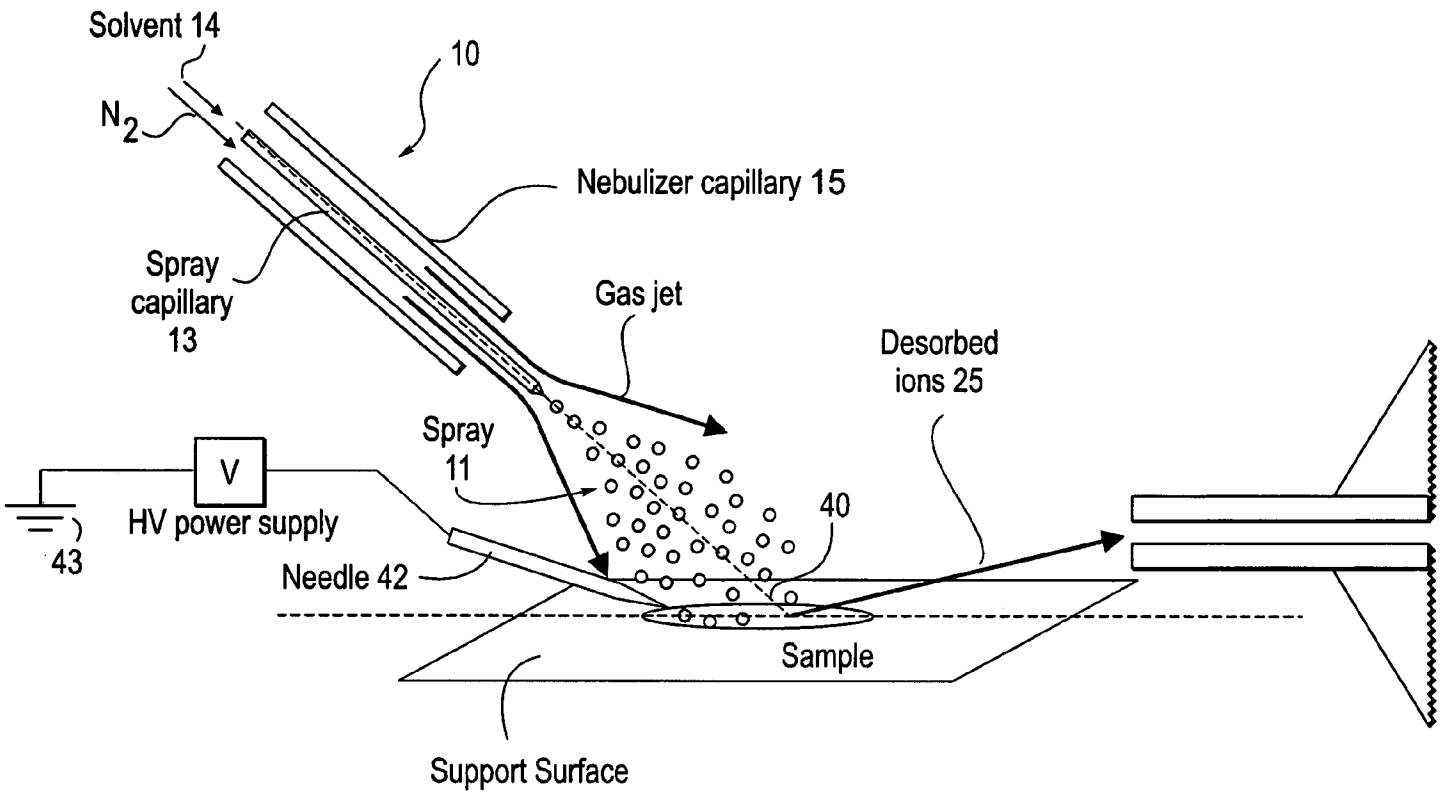
FIG. 13 shows an alternative embodiment of a device made according to the present invention adapted for use in imaging the sample surface in finer detail.

The alternative embodiment shown in FIG. 13 is useful in most DESI applications but is especially useful in applications where finely detailed imaging of the sample surface or of the distribution of materials on a surface is desired. As is shown in FIG. 13, nebulized droplets 11 of an uncharged liquid are directed onto a surface of sample 40 in a gas, using a spray device 10 substantially as is shown in FIG. 1, and bearing the same reference numbers. However, there is no voltage applied to the liquid capillary. Rather a needle 42 is positioned near the sample surface 40 at the location sought to be imaged and a voltage is applied between the needle 42 and a ground electrode 43. The voltage on the needle 42 is less than the arcing threshold but sufficient to create a field that will charge the nebulized solvent droplets just prior to their contact with the sample surface 40. The charged nebulized droplets from the nebulizer capillary will contact a small area of the sample surface directly beneath the needle allowing detailed imaging of the surface. Movement of the sample allows formation of an image.

The resolution of DESI-based imaging can also be improved by using a mask that physically limits the area of contact between the DESI-active spray and the sample so that desorbed ions are collected from a narrowly defined area of the sample surface. Masking also can be used to physically limit the collected ions to those having a substantially straight-line trajectory between the sample and the atmospheric pressure interface of the mass spectrometer. An alternative arrangement for increasing resolution of DESI-based imaging makes use of a field established between the approximate plane of the sample and a grid positioned between the sample and the source of the DESI-active spray. The field is polarized to resist the flow of ions or charged droplets in the DESI-active spray. An elongated, conductive member, typically a wire, traverses the field so that one end is positioned near the source of the DESI-active spray and the other is adjacent to an area of interest for imaging on the surface. The conductive member is charged so as to create a tunnel-shaped field parallel to its axis that facilitates passage of ions and charged droplets in the DESI-active spray. The fields work together to limit contact between the DESI-active spray and the surface to a small area having a relatively high concentration of DESI-active spray components compared with that observed without physical masking.

Yet another useful arrangement for improving image resolution involves contacting a surface with a DESI-active spray having an energy level just below the level needed for ionization and desorption while at the same time adding sufficient energy to cross the ionization and desorption interaction threshold by means of, for example, a laser capable of rastering the sample with a very small spot of heat.

FIG. 1 of the accompanying drawings shows schematically and in elevated cross section the electrospray 10 found to be useful for contacting a liquid surface with a DESI-active spray 11. In one example, an aqueous solution of methanol (50% v/v) was electrosprayed into a nebulizing gas at an electrospray voltage of 5 kV, and the resulting DESI-active spray 11 was directed into contact with a liquid sample containing bradykinin present on a PMMA surface. The incident angle ($\alpha$) in this particular example was no more than 45° and the volumetric flow rate of the solvent was 1-3 μL/min. Angle $\beta$ was approximately 10° relative to the atmospheric inlet of a Thermofinnigan LTQ mass spectrometer 23. The relatively lower incident angle was used as a practical expedient to avoid excessive disruption of the liquid sample by contact with the DESI-active spray 11.

In summary the DESI system using a DESI-active spray can be used to interact with a sample to ionize, and desorb sample material (not necessarily in this order) and generate desorbed ions for analysis. The desorbed ions can be analyzed by a mass spectrometer or other analyzer. The DESI-active spray can contact the sample material at substantially atmospheric pressures and in an uncontrolled environment. The sample material can be supported by a conductive or insulating surface, or be part of a naturally occurring structure, or can be a liquid or a frozen material. For example, the sample can be supported on common environmental surfaces such as clothing, luggage, paper, furniture, upholstery, and tools. Or, the sample may be part of the skin, hair, biological tissue, food, food ingredients, bodies of water, streams, waste water, standing water, toxic liquid, and marine water. Alternatively, the sample may be in a controlled environment. The sample material may be in a medical research, academic, or industrial setting. The sample material may be bound to a sample slide by one or more ligands, receptors, lectins, antibodies, binding partners, chelates, or the like to form an array. The sample material may be a food, or food ingredient. The DESI-active spray generally consists of water and water alcohol mixtures. However, the spray may also include a reactant for the sample materials such that contacting the sample material with DESI-active spray resulting in detectable ions desorbed from the sample material including ions of a reaction product of the reactant and the sample.

The DESI system may include a flexible transfer line for transferring the sample ions into and mass spectrometer or other analyzing apparatus. The sample material may be contacted at a plurality of locations thereby providing a map of the ions from different parts of the sample. The sample may be moved to expose different areas to the DESI-active spray. Masking, field masking, and other methods may be used to direct the spray to specific locations. The data obtained from various reactions can be used to produce an image or map of distribution of the components of the material in the sample.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A method for desorbing and ionizing an analyte in a sample material comprising directing DESI-active spray droplets onto the surface of the sample material to interact with the surface and desorb the analyte.

2. The method of claim 1 in which the spray which contacts the surface has charged droplets.

3. The method of claim 1 in which the desorbed analyte is charged after it is desorbed.

4. The method of claim 2 which the droplets are charged as they are formed.

5. The method of claims 1, 2 or 3 wherein the DESI-active spray contacts the sample material at substantially atmospheric pressure.

6. The method of claim 1 wherein the DESI-active spray contacts the sample material in an ambient environment.

7. The method of claim 1 wherein the DESI-active spray droplets as generated by introducing a liquid into nebulizing gas.

8. The method of claim 4 wherein the DESI-active spray droplets as generated by an electrospray device.

9. The method of claims 1, 2, or 3 in which the droplets are selected from the group consisting of water, alcohol and mixtures thereof.

10. The method of claim 8 wherein the liquid contains a minor amount of an ionization promoter.

11. The method of claim 8 wherein the liquid contains a reagent for the sample material such that contacting the sample material with the DESI-active spray results in detectable desorbed analyte ions which include reaction products of the reagent and the sample material.

12. The method of claim 6 wherein a reagent is added to the liquid to generate desorbed ions of the reaction product of the sample material and the reagent.

13. The method of claim 8 wherein the sample is a biological material and the reagent is a biochemical material that reacts with the biological materials to form desorbed analyte ions of the chemical reaction.

14. The method of claim 8 wherein ions are introduced into the liquid to interact with the sample material and generate desorbed ions of complexes between the sample material and the ions.

15. The method of claim 1 in which the DESI-active spray is configured to spray a spot on the sample and the spot is scanned to provide desorbed ions representing different parts of the sample.

16. The method of claim 15 in which the sample and spot are moved relative to one another to produce ions of the analyte in the sample material from different locations of the sample material and the produced ions are associated with the location of the spot.

17. The method of claim 16 wherein the locations of the spots are used to form an image of the analyte ions on the sample.

18. The method of claim 15 in which the spot is configured by masking.

19. The method of claim 15 in which the spot is configured by spraying mobilized droplets of the liquid toward the surface of the sample material and the droplets are charged by applying a charging electric field to the droplets at the location of the spot.

20. The method of claim 15 in which the spot is configured by directing the DESI-active spray to the surface of the sample material with an energy level just below the level needed for desorption and ionization of the analyte in the sample material and adding sufficient energy at the spot to cross the desorption and ionization threshold for the analyte.

21. The method of claim 20 in which the energy is supplied by a laser.

22. The method of claim 1 wherein the DESI-active spray contacts the sample material in a controlled environment.

23. The method of claim 1 wherein the DESI-active spray contacts the sample material in an uncontrolled environment.

24. The method of claim 1 in which in the sample is on a solid or flexible surface.

25. The method of claim 1 in which the sample is a liquid.

26. The method of claim 1 in which the sample material is frozen.

27. The method of claim 1 in which the sample material is supported on a sample slide.

28. The method of claim 27 in which the sample material is arranged as an array on the sample slide.

29. A method for ionization and desorbing an analyte in a sample as in claim 1 or 15 in which one or more samples are bound to a sample slide by one or more ligands, receptors, lectins, antibodies, binding partners, chelates, or the like.

30. The method as in claim 1 wherein the sample material is of biological origin.

31. The method of claim 1 wherein the sample material is an industrial work piece or pharmaceutical product or ingredient.

32. The method of claim 1 wherein the sample material is selected from the group comprising a food or food ingredient, toxin, a drug, an explosive, a bacterium or biological tissue.

33. The method of analyzing sample material which comprises desorbing and ionizing the analyte as in claim 1 and then collecting and analyzing the analyte ions.

34. The method of claim 33 in which the analyte ions are analyzed by a mass spectrometer.

35. The method of claim 33 in which the analyte ions are transferred from the vicinity of the sample material to the mass spectrometer by an ion transfer line.

36. The method of claim 33 comprising spraying the sample material at a plurality of locations and mass analyzing the analyte ions at each location.

37. The method of claim 36 comprising using the mass analysis at each location to develop an image of the distribution of analyte masses at the surface of the sample.

38. A system for analyzing a sample material comprising: apparatus for generating a DESI-active spray and directing it onto the surface of the sample to interact with the surface and generate ions of analytes in the sample; a mass analyzer; and an ion transfer line for transferring the generated ions from the sample material to the mass analyzer.

39. The system of claim 38 in which the mass analyzer is a mass spectrometer.

40. The system of claim 38 in which the DESI-active spray is generated by an electrospray device.

41. Apparatus for analyzing an analyte situated on a substrate comprising: a source of DESI-active spray directable toward the substrate; and an analyzer with an intake positionable in sufficiently close proximity to the substrate to collect desorbed ionic products of the analyte generated by the DESI-active spray.

42. The apparatus of claim 41 further comprising a spectrometer coupled to the analyzer intake.

43. The apparatus of claim 42 wherein the spectrometer comprises a mass spectrometer.

44. The apparatus of claim 41 wherein the source of DESI-active spray and the analyzer intake are coupled to each other.

45. The apparatus of claim 41 further comprising a stage for holding the substrate.

46. The apparatus of claim 45 wherein the said substrate is maintained at a controlled temperature.

47. The apparatus of claim 41 further comprising a heater coupled to the analyzer intake.

* * * * *